US008632065B2

(12) United States Patent
Nozawa et al.

(10) Patent No.: US 8,632,065 B2
(45) Date of Patent: Jan. 21, 2014

(54) SHEET PROCESSING APPARATUS

(75) Inventors: Shigeki Nozawa, Toyokawa (JP); Ryouta Shibayama, Okazaki (JP); Zen Kayaba, Tama (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 0 days.

(21) Appl. No.: 13/423,402

(22) Filed: Mar. 19, 2012

(65) Prior Publication Data

US 2012/0245012 A1 Sep. 27, 2012

(30) Foreign Application Priority Data

Mar. 23, 2011 (JP) ..... 2011-063909
Mar. 23, 2011 (JP) ..... 2011-063910

(51) Int. Cl.
*B65H 45/04* (2006.01)

(52) U.S. Cl.
USPC ..... 270/58.28; 270/32; 270/58.07; 270/58.1; 270/58.11

(58) Field of Classification Search
USPC ..... 270/32, 37, 45, 58.07, 58.1, 58.11, 270/58.13, 58.28
See application file for complete search history.

(56) References Cited

U.S. PATENT DOCUMENTS 5,605,322 A * 2/1997 Suzuki et al. ..... 270/58.13
7,677,544 B2 * 3/2010 Awano ..... 270/58.11
2008/0214377 A1 * 9/2008 Kamiya ..... 493/421
2008/0315490 A1 * 12/2008 Uchiyama et al. ..... 270/45
2009/0221411 A1 * 9/2009 Endo ..... 493/407
2010/0019446 A1 * 1/2010 Matsumoto et al. ..... 271/302
2011/0084436 A1 * 4/2011 Shirakuma et al. ..... 270/37

FOREIGN PATENT DOCUMENTS

JP 62-011856 1/1987
JP 63-41350 A 2/1988
JP 2002060113 A * 2/2002
JP 2002316768 A * 10/2002
JP 2003-089462 3/2003
JP 2004-284762 10/2004
JP 2004331332 A * 11/2004
JP 2007-039234 2/2007
JP 2007-161414 A 6/2007
JP 2010-058907 3/2010

OTHER PUBLICATIONS

Office Action issued on Apr. 16, 2013 by Japan Patent Office in corresponding Japanese Patent Application No. 2011-063910, and English translation thereof.

* cited by examiner

*Primary Examiner* — Leslie A Nicholson, III
(74) *Attorney, Agent, or Firm* — Buchanan Ingersoll & Rooney PC

(57) ABSTRACT

The sheet processing apparatus processes a sheet having an image formed thereon by an image forming apparatus. The sheet processing apparatus includes a sheet folding unit for folding the sheet having an image formed thereon, a sheet tray loaded with the sheet folded by the sheet folding unit to be taken out, and a control unit for controlling the sheet processing apparatus as a whole. The sheet tray includes a mechanism capable of adjusting an angle with a virtual plane and a detection device detecting a change of the angle with the virtual plane. The control unit prohibits ejection from the sheet folding unit to the sheet tray, based on the detection result of the detection device and the content of the folding processing by the sheet folding unit.

11 Claims, 20 Drawing Sheets

FIG.15

| SHEET TRAY | THREE-FOLDING | CENTER-FOLDING | CENTER-STAPLING |
|---|---|---|---|
| LOWEST POSITION | 75s | 30s | 22.5s |
| INTERMEDIATE POSITION | 45s | 22.5s | 15s |
| HIGHEST POSITION | 30s | 15s | 7.5s |

FIG.17

| SHEET TRAY | THREE-FOLDING | | CENTER-FOLDING/ CENTER-STAPLING | |
|---|---|---|---|---|
| | STANDARD PAPER | THICK PAPER | STANDARD PAPER | THICK PAPER |
| HIGHEST POSITION | UP TO 1 SHEET | PROHIBITED | UP TO 5 SHEETS | PROHIBITED |
| INTERMEDIATE POSITION | UP TO 1 SHEET | PROHIBITED | UP TO 10 SHEETS | PROHIBITED |
| LOWEST POSITION | UP TO 3 SHEETS | UP TO 1 SHEET | UP TO 20 SHEETS | UP TO 5 SHEETS |

SHEET PROCESSING APPARATUS

This application is based on Japanese Patent Applications Nos. 2011-063909 and 2011-063910 filed with the Japan Patent Office on Mar. 23, 2011, the entire content of which is hereby incorporated by reference.

BACKGROUND OF THE INVENTION

1. Field of the Invention

The present invention relates to a sheet processing apparatus receiving a recorded sheet ejected from an image forming apparatus and performing prescribed post-processing.

2. Description of the Related Art

Sheet processing apparatuses are widely used in recent years. The sheet processing apparatus receives a recorded sheet ejected from an image forming apparatus such as a printer and a copier and performs prescribed post-processing.

Specifically, a sheet processing apparatus is provided with post-processing means for stapling, punching (making circular holes), and folding paper having an image formed thereon.

Among others, for a sheet processing apparatus that binds recorded sheets, ejected from an image forming apparatus, into a book, a variety of proposes have been made so far. For example, proposed is a sheet processing apparatus in which stacked sheets ejected from an image forming apparatus are stitched at the center, and the sheets are folded into two at the stitched portion and bounded into a book, which is then loaded onto a sheet tray for removal.

For example, Japanese Laid-Open Patent Publication No. 2004-284762 discloses a technique of stacking and aligning a number of sheets on a sheet tray to be loaded with sheets ejected from an image forming apparatus.

However, the sheet tray is generally provided at a lower portion of the sheet processing apparatus. Therefore, in order to take out a pile of sheets, users have to change their postures down to the position of the sheet tray provided at the lower portion. In this manner, there is some inconvenience in taking out sheets from the sheet tray.

In this respect, it is possible to tilt the angle of the sheet tray to facilitate removal of sheets from the sheet tray. However, when the angle of the sheet tray is changed, the sheet ejection angle with respect to the sheet tray is changed. Therefore, when sheets are elastic depending on the type and number of ejected sheets, the sheets are not ejected properly, resulting in paper jam, paper stuck, and the like.

SUMMARY OF THE INVENTION

The present invention is made to solve the aforementioned problem. An object of the present invention is to provide a sheet processing apparatus capable of properly ejecting sheets in a configuration that allows adjustment of the angle of a sheet tray.

A sheet processing apparatus according to an aspect of the present invention processes a sheet having an image formed thereon by an image forming apparatus. The sheet processing apparatus includes: a sheet folding unit for folding the sheet having an image formed thereon; a sheet tray loaded with the sheet folded by the sheet folding unit to be taken out; and a control unit for controlling the sheet processing apparatus as a whole. The sheet tray includes a mechanism capable of adjusting an angle with a virtual plane, and a detection device for detecting a change of the angle with the virtual plane. The control unit prohibits ejection from the sheet folding unit to the sheet tray based on a detection result of the detection device and the content of folding processing in the sheet folding unit.

Preferably, the control unit determines whether ejection from the sheet folding unit to the sheet tray is possible, based on a detection result of the detection device and the number of times of folding processing in the sheet folding unit, and prohibits ejection from the sheet folding unit to the sheet tray based on a result of the determination.

Preferably, the control unit determines whether ejection from the sheet folding unit to the sheet tray is possible, based on a detection result of the detection device and the kind of the sheet to be folded by the sheet folding unit, and prohibits ejection from the sheet folding unit to the sheet tray based on a result of the detection.

Preferably, the control unit determines whether ejection from the sheet folding unit to the sheet tray is possible, based on a detection result of the detection device and the number of the sheets to be folded by the sheet folding unit, and prohibits ejection from the sheet folding unit to the sheet tray based on a result of the detection.

Preferably, the sheet tray includes a conveyance belt for conveying the sheet. In a first conveyance mode, the control unit ejects the sheet loaded so as to be stacked by moving the conveyance belt stepwise. In a second conveyance mode, the control unit ejects the sheet loaded so as to be positioned at an end portion of the sheet tray by moving the conveyance belt.

In particular, the sheet tray further includes a first sensor for detecting a position of the sheet folded by the sheet folding unit and ejected onto the sheet tray, and a second sensor for detecting a position of the sheet conveyed to an end portion of the sheet tray by the conveyance belt.

In particular, in the first conveyance mode, the control unit uses the first sensor to sense the sheet folded by the sheet folding unit and ejected onto the sheet tray, moves the conveyance belt in response to sensing by the first sensor, and moves the conveyance belt until the first sensor no longer senses the sheet. In the second conveyance mode, the control unit uses the second sensor to sense the sheet folded by the sheet folding unit and ejected onto the sheet tray, and moves the conveyance belt until a prescribed period has elapsed.

In particular, the sheet folding unit is capable of performing a plurality of processing on the sheet according to an instruction. The control unit adjusts the prescribed period depending on the processing performed by the sheet folding unit.

In particular, the control unit switches the first and second conveyance modes from one to another based on a detection result of the detection device.

In particular, the control unit ejects the sheet folded by the sheet folding unit so as to be stacked, according to the first conveyance mode, in response to input of a job to the sheet folding unit until the job is completed. The control unit determines whether a new job is input after completion of the job, and if it is determined that no new job is input, the control unit switches the first conveyance mode to the second conveyance mode and moves the conveyance belt to eject the sheet such that the sheet is positioned at an end portion of the sheet tray. In the second conveyance mode, when a new job is input, the control unit switches the second conveyance mode to the first conveyance mode.

In particular, the control unit switches the first and second conveyance modes from one to another according to an instruction from an operation panel provided in the image forming apparatus.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 15 is a correspondence table of sheet tray 800 and sheet piling time based on post-processing modes.

FIG. 17 is a diagram illustrating an ejection restriction table according to the embodiment of the present invention.

DESCRIPTION OF THE PREFERRED EMBODIMENTS

Figure 1:
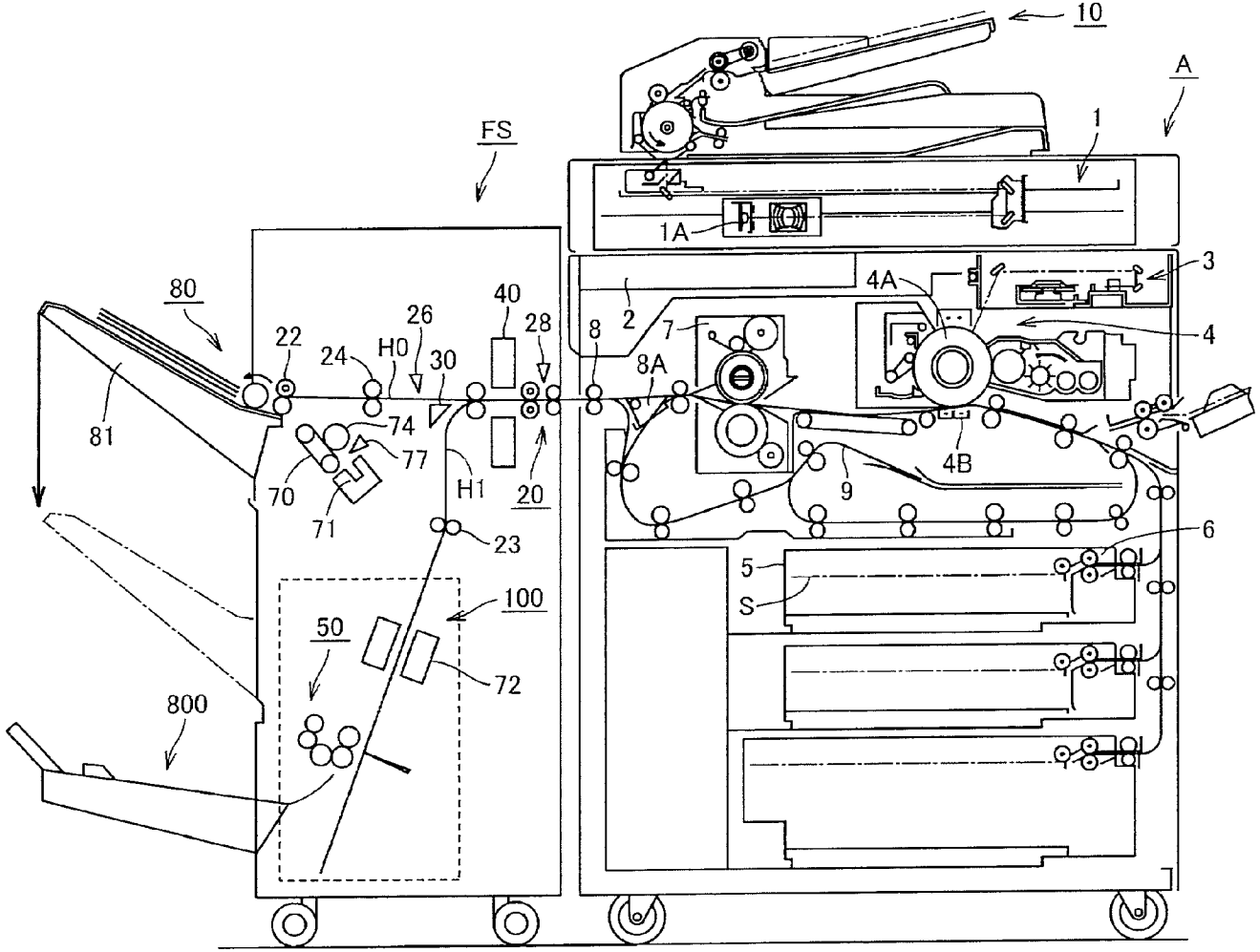
FIG. 1 is a schematic cross-sectional view of an image forming system including a post-processing apparatus (sheet processing apparatus) FS and an image forming apparatus A according to an embodiment of the present invention.

In the following, embodiments of the present invention will be described with reference to the figures. In the following description, the same parts and components are denoted with the same reference numerals. Their names and functions are also the same. Therefore, a detailed description thereof will not be repeated.

(Image Forming System)

FIG. 1 is a schematic cross-sectional view of an image forming system including a post-processing apparatus (sheet processing apparatus) FS and an image forming apparatus A according to an embodiment of the present invention.

(Image Forming Apparatus A)

The image forming apparatus A includes an image scanning unit 1, an image processing unit 2, an image writing unit 3, an image forming unit 4, a paper-feed cassette 5, a paper-feed roller 6, a fixing device 7, a paper-ejection roller 8, and an automatic duplex copy paper-feed unit 9.

An automatic document feeder 10 is mounted at the top of the image forming apparatus A. Post-processing apparatus FS is coupled to the side of paper-ejection roller 8 on the shown left side surface of the image forming apparatus A. A document placed on a document table of automatic document feeder 10 is conveyed along a conveyance path, and an image on one side or both sides of the document is scanned by an optical system of image scanning unit 1 and read by a CCD image sensor 1A.

An analog signal obtained through photoelectric conversion by CCD image sensor 1A is subjected to analog processing, A/D conversion, shading correction, image compression processing, etc. in image processing unit 2 and thereafter sent to image writing unit 3. A semiconductor laser is driven to emit light based on image data sent to image writing unit 3, and the light is applied to a photoconductor drum 4A of image forming unit 4 to form a latent image. In image forming unit 4, processing such as charging, exposure, development, transfer, separation, and cleaning is performed, resulting in a toner image on photoconductor drum 4A.

A recording sheet S fed from paper-feed cassette 5 to paper-feed roller 6 reaches photoconductor drum 4A, where the toner image is transferred onto recording sheet S by transfer means 4B. Recording sheet S carrying the toner image is subjected to fixing processing by fixing device 7 and is sent from paper-ejection roller 8 to post-processing apparatus FS. In duplex copy, recording sheet S having an image processed on one side is sent to automatic duplex copy paper-feed unit 9 by a conveyance path switching plate 8A, and a toner image is transferred onto the back side and fixed in image forming unit 4 and is thereafter sent from paper-ejection roller 8 to post-processing apparatus FS.

(Post-Processing Apparatus FS)

The post-processing apparatus FS has a paper delivery unit 20 and a plurality of post-processing units. The post-processing units include a punching unit 40, a folding unit 50, a side-stapling unit 71, a center-stapling unit 72, and a paper ejection unit 80.

Recording sheet S having an image formed thereon (also referred to as "sheet"), which is sent from paper-ejection roller 8 of image forming apparatus A to post-processing apparatus FS, is conveyed to the inside of post-processing apparatus FS by paper delivery unit 20.

Punching unit 40 is arranged on the left side downstream of paper delivery unit 20 to punch a hole in sheet S. Specifically, an entrance sensor 28 is provided in the vicinity of the entrance of post-processing apparatus FS. When sheet S is delivered to post-processing apparatus FS, entrance sensor 28 senses the delivery of sheet S. Then, after a prescribed time has passed since the delivery of sheet S is sensed, the conveyance of sheet S is stopped, so that punching unit 40 punches a hole in sheet S (punch processing).

Downstream from punching unit 40, two conveyance paths H0, H1 branch off. The switching between these conveyance paths H0 and H1 is performed by a conveyance path switching member 30. Conveyance path H1 branching off downward passes through a conveyance roller 23 to reach a saddle 100. In saddle 100, which will be described later, center-stapling unit 72 and folding unit 50 are arranged as detailed later.

The other conveyance path H0 passes through a conveyance roller 24 to reach paper ejection unit 80.

In post-processing apparatus FS, when a large volume of image forming is performed without processing by the post-processing unit, sheet S passes from paper delivery unit 20 through paper conveyance path H0 and ejects from an ejection paddle 22 of paper-ejection unit 80 to an elevate tray 81 at the exit of post-processing apparatus FS.

Elevate tray 81 moves downward as shown by the dotted and dashed line in the drawing such that the top face of the ejected sheets S is always kept at a constant height. Therefore, thousands of sheets can be piled on elevate tray 81. A sheet detection sensor 26 is provided on conveyance path H0 to sense passage of sheet S on conveyance path H0, so that timing control of driving conveyance roller 24, ejection paddle 22, and the like is executed.

Ejection paddle 22 is configured to be movable between a pressure-contact state and a separate state. When ejection paddle 22 is in a pressure-contact state, sheet S is ejected to elevate tray 81 as described above. On the other hand, when ejection paddle 22 is in a separate state, sheet S is not immediately ejected to elevate tray 81, and the back end of sheet S drops onto an accommodation belt 70 after sheet S reaches ejection paddle 22. Then, accommodation belt 70 and an accommodation paddle 74 rotate to convey the sheet in the direction toward side-stapling unit 71. This process is executed multiple times on a plurality of sheets S. A processing tray sensor 77 senses that a prescribed number of sheets are accommodated in side-stapling unit 71 for execution of side-stapling processing. Thereafter, accommodation belt 70 and accommodation paddle 74 convey the side-stapled sheet stack in the direction to ejection paddle 22. The sheet stack is then ejected from ejection paddle 22 to elevate tray 81.

Saddle 100 is arranged at a slant with respect to the horizontal direction downstream from conveyance roller 23. Saddle 100 has a plurality of guide members for guiding sheet S and a front end stopper, center-stapling unit 72, folding unit 50, and a paper width alignment unit to process one or more sheets S in each of a center-fold (two-fold) mode, a center-fold/center-stapling mode, and a three-fold mode and eject the processed sheet to sheet tray 800. In this example, two-fold or three-fold processing is performed on one or more sheets S in saddle 100, and therefore, the sheet ejected to sheet tray 800 is also referred to as the folded sheet.

Figure 2:
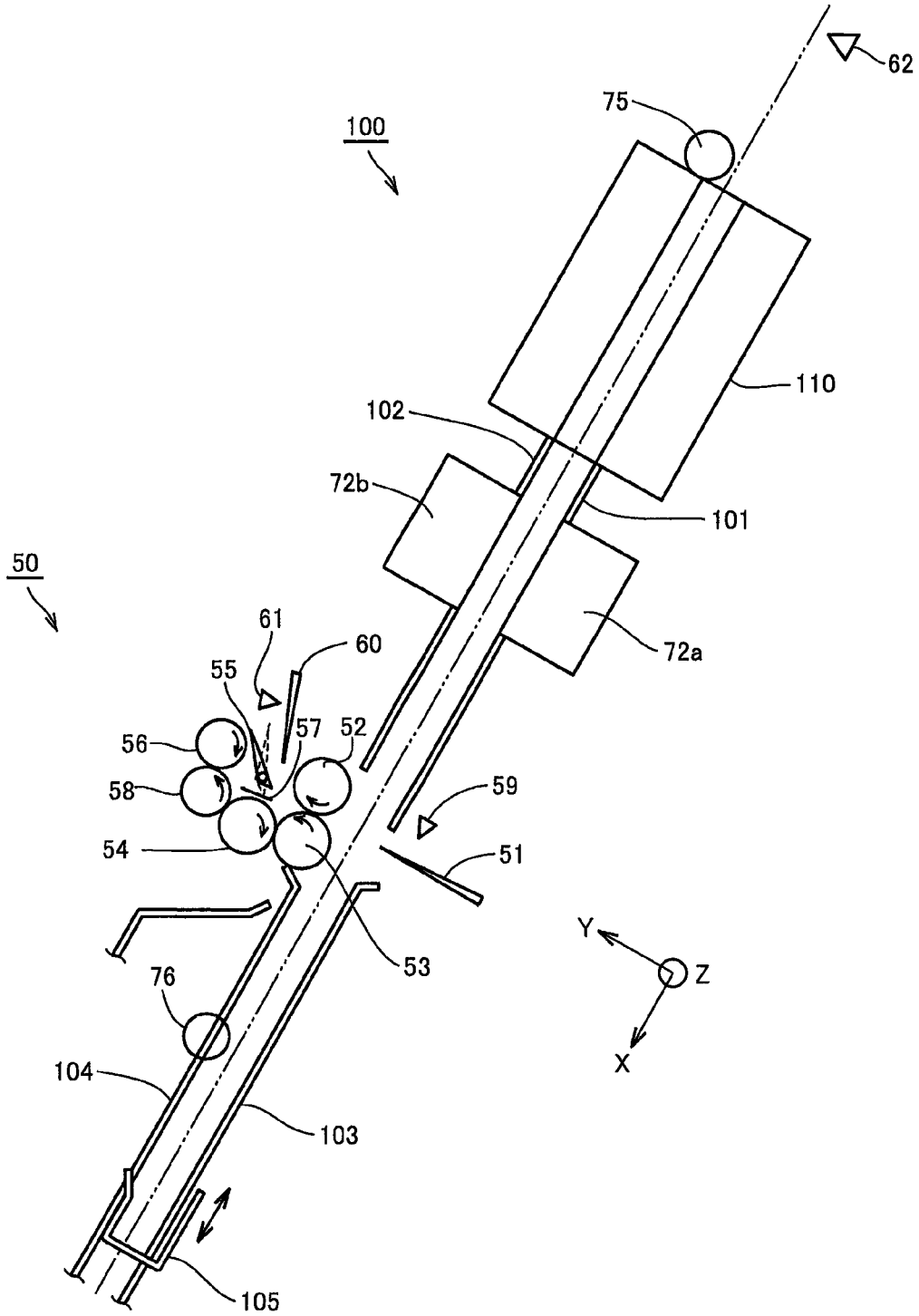
FIG. 2 is an enlarged cross-sectional view of a main part of a saddle unit 100 of post-processing apparatus FS according to the embodiment of the present invention.

FIG. 2 is an enlarged cross-sectional view of a main part of saddle unit 100 of post-processing apparatus FS according to the embodiment of the present invention.

Referring to FIG. 2, sheet S is delivered from the obliquely upper side to the obliquely lower side. As shown in the lower right portion in the drawing, in the following description, the obliquely downward direction is the X direction, the direction orthogonal to the X direction on the plane of the drawing sheet is the Y direction, and the direction vertical to the plane of the drawing sheet is the Z direction.

The guide members of saddle 100 include upstream guide members 101, 102 and downstream guide members 103, 104. A paper width alignment unit 110 is positioned on the upper side of upstream guide members 101, 102. Center-stapling unit 72 is arranged at the middle of upstream guide members 101, 102. Folding unit 50 is positioned between upstream guide members 101, 102 and downstream guide members 103, 104.

Sheets S delivered into saddle 100 through conveyance path H1 are detected one by one by a saddle delivery sensor 62. Then, the delivered sheet S is conveyed under its own weight along the guide members. At that time, an upper paddle 75 and a lower paddle 76 rotate in contact with the surface of the sheet, whereby sheets are smoothly conveyed one by one.

Paper width alignment unit 110 aligns sheets S in the width direction (the Z/opposite Z direction). Downstream from folding unit 50, a front end stopper 105 is provided which can move along downstream guide members 103, 104. Front end stopper 105, which restricts the lower end of sheet S at a prescribed position, is moved according to the paper size.

Upstream guide member 101 and downstream guide member 103 are positioned on the lower side of saddle 100 (the opposite Y direction side) to form a stack plane on which sheets S are slidably dropped and stacked. Upstream guide member 102 and downstream guide member 104 are arranged to be spaced apart from and opposed to upstream guide member 101 and downstream guide member 103.

Center-stapling unit 72 includes a staple-receiving mechanism 72*a* and a staple-driving mechanism 72*b*. When the central portion of a stack of sheets S in the paper conveyance direction is positioned by front end stopper 105, center-stapling unit 72 is operated to staple the stack of sheets S at the center. Specifically, front end stopper 105 is moved in the paper conveyance direction of sheet S (the X/opposite X direction), whereby a plurality of sheets S are stacked with the central portions thereof aligned with center-stapling unit 72. After a plurality of sheets S are stacked, the stack of sheets S are center-stapled by center-stapling unit 72. When the center-stapling processing is not performed in center-stapling unit 72, sheets S are stacked such that the central portions of sheets S are aligned with folding unit 50.

Folding unit 50 includes a first folding plate 51, a first folding roller 52, a second folding roller 53, a third folding roller 54, a fourth folding roller 56, a fifth folding roller 58, a conveyance path switching member 55, a guide member 57, a first folding plate sensor 59, a second folding plate 60, and a second folding plate sensor 61. Folding unit 50 performs center-folding (two-folding) or three-folding processing on sheet S.

Figure 3:
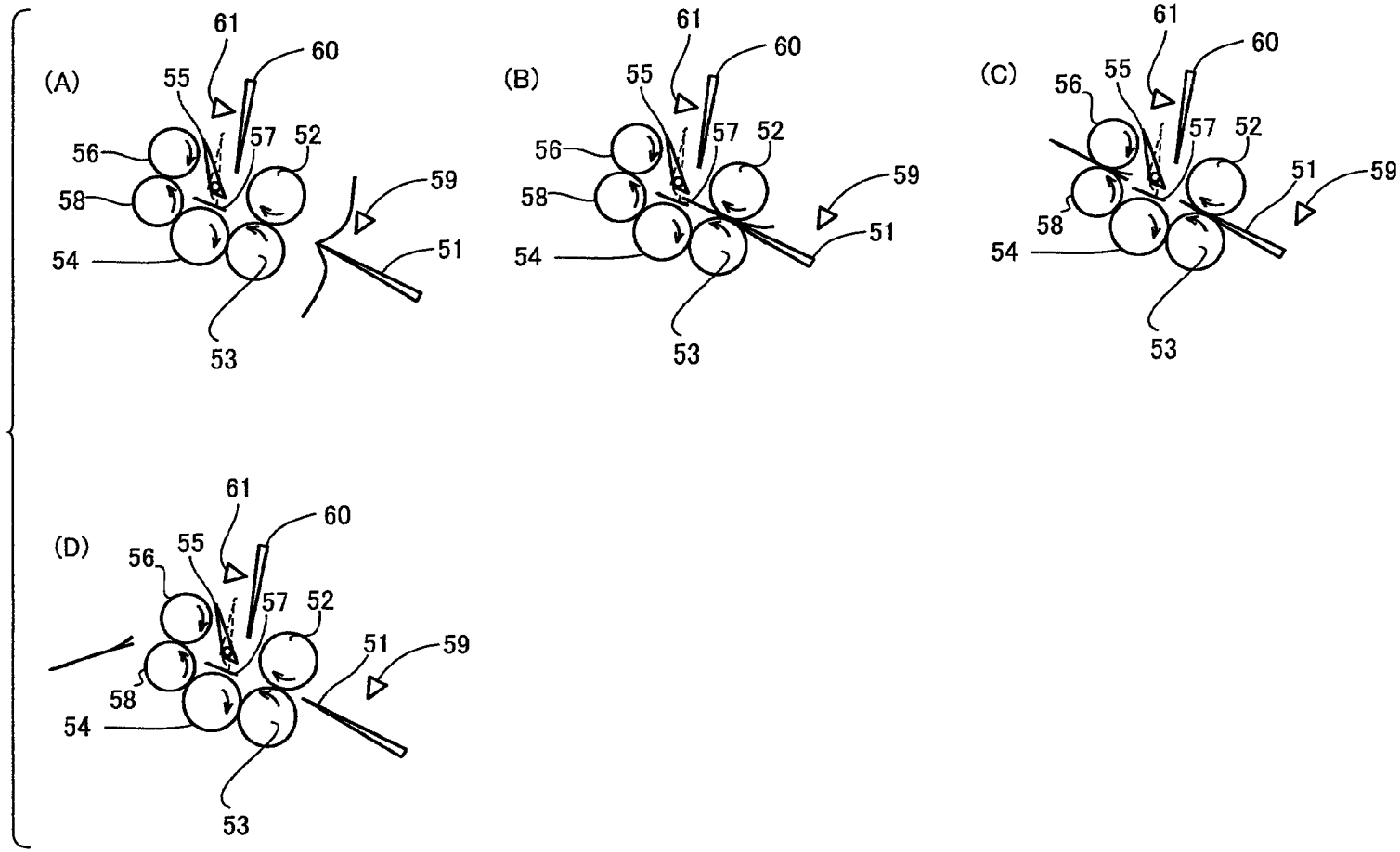
FIG. 3 is a diagram illustrating center-folding (two-folding) processing according to the embodiment of the present invention.

FIG. 3 is a diagram illustrating center-folding (two-folding) processing according to the embodiment of the present invention.

Referring to FIG. 2 and FIG. 3, in the center-folding (two-folding) processing, first, front end stopper 105 is moved such that the central portion in length of sheet S is positioned at first folding plate 51. Then, as shown in FIG. 3(A), while first and second folding rollers 52, 53 are rotating, first folding plate 51 inserts sheet S between first folding roller 52 and second folding roller 53. First folding roller 52 and second folding roller 53 are biased so as to be brought into pressure-contact with each other by a not-shown spring member, so that folding processing is performed by putting a crease on sheet S at the central portion thereof in FIG. 3(B). Then, sheet S subjected to folding processing is conveyed to fourth and fifth folding rollers 56, 58 by guide member 57 provided below conveyance path switching member 55. As shown in FIG. 3(C), fourth and fifth folding rollers 56, 58 rotate to convey the folding-processed sheet S. Then, in FIG. 3(D), fourth and fifth folding rollers 56, 58 eject the folding-processed sheet S to sheet tray 800. First folding plate sensor 59 detects the home position of first folding plate 51, so that the moved first folding plate 51 is returned to the home position.

Figure 4:
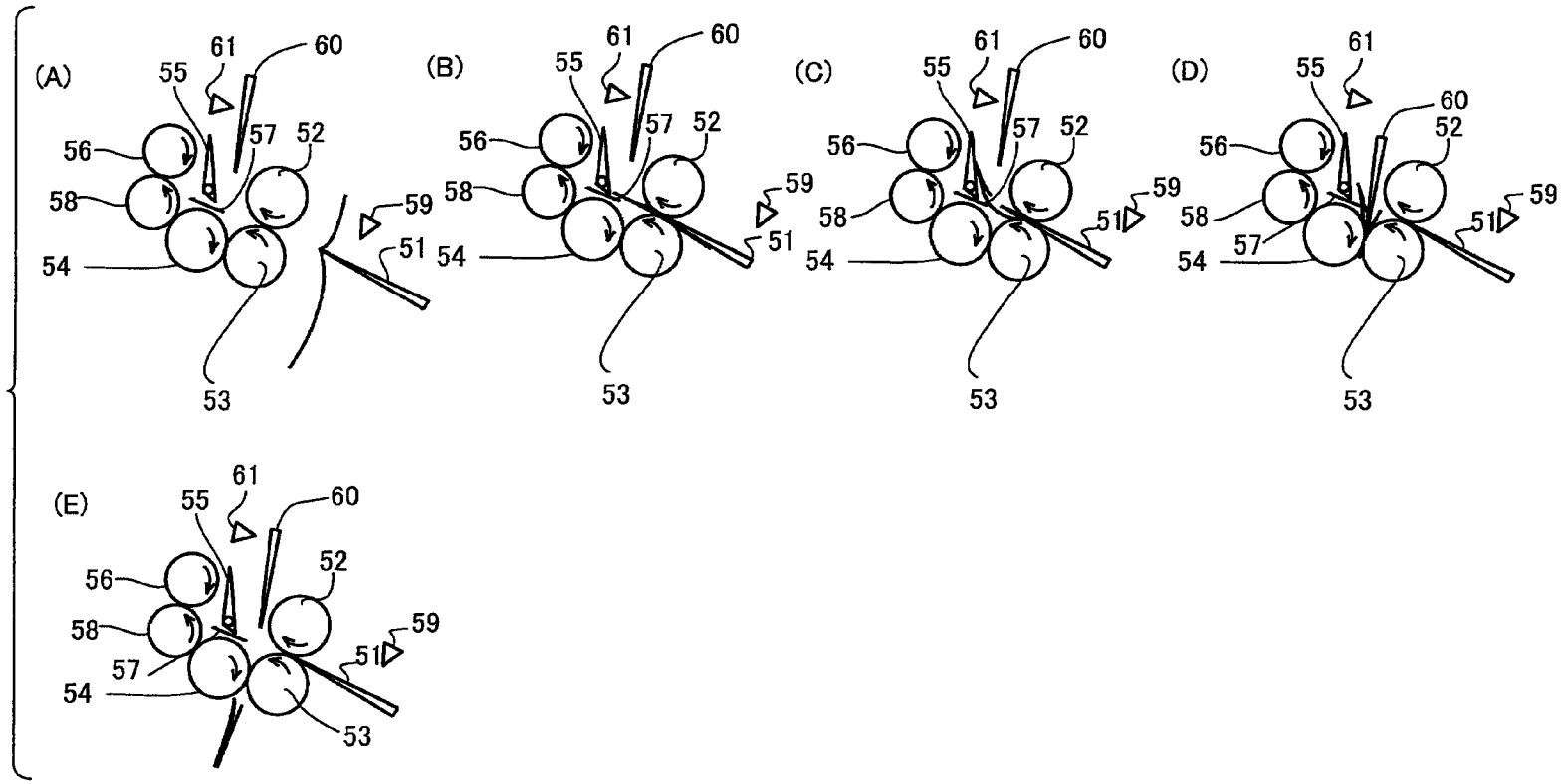
FIG. 4 is a diagram illustrating three-folding processing according to the embodiment of the present invention.

FIG. 4 is a diagram illustrating three-folding processing according to the embodiment of the present invention.

Referring to FIG. 2 and FIG. 4, first, in the three-folding processing, conveyance path switching member 55 is moved and set at the position shown by the dotted line in FIG. 2. Then, sheet S is moved by front end stopper 105 such that the position at one-third of its length is positioned at folding plate 51. Then, as shown in FIG. 4(A), while first and second folding rollers 52, 53 rotate, first folding plate 51 inserts sheet S between first folding roller 52 and second folding roller 53. In FIG. 4(B), folding processing is performed by putting a crease in sheet S at the position at one-third of its length. Then, in FIG. 4(C), sheet S is guided, with the crease being ahead, upward along the shape of conveyance path switching member 55. Sheet S guided along the shape of conveyance path switching member 55 is stopped by a not-shown stop member. The stop member is used to position sheet S when folding processing is performed by second folding plate 60, and adjusts the central portion in length of the folding-processed sheet S such that it is positioned where second folding plate 60 puts a crease.

Then, in FIG. 4(D), while second folding roller 53 and third folding roller 54 are rotating, second folding plate 60 inserts sheet S between second folding roller 53 and third folding roller 54. Second folding roller 53 and third folding roller 54 are biased so as to be brought into pressure contact with each other by a not-shown spring member. Folding processing is performed on the folding-processed sheet S by second folding plate 60 putting an additional crease at the central portion in the remaining length. In FIG. 4(E), second and third folding rollers 53, 54 rotate to eject the folding-processed sheet S to sheet tray 800. First folding plate sensor 59 detects the home position of first folding plate 51, so that the moved first folding plate 51 is returned to the home position. The second folding plate sensor 61 detects the home position of second folding plate 60, so that the moved second folding plate 60 is returned to the home position. In the three-folding processing, first, sheet S is folding-processed at the position at one-third of its length, and then, a crease is put at half the remaining length such that the folding-processed side is folded.

Here, the two-folding or three-folding processing of one sheet S is described. However, not being limited to one sheet, the similar processing can be performed on multiple sheets.

Figure 5:
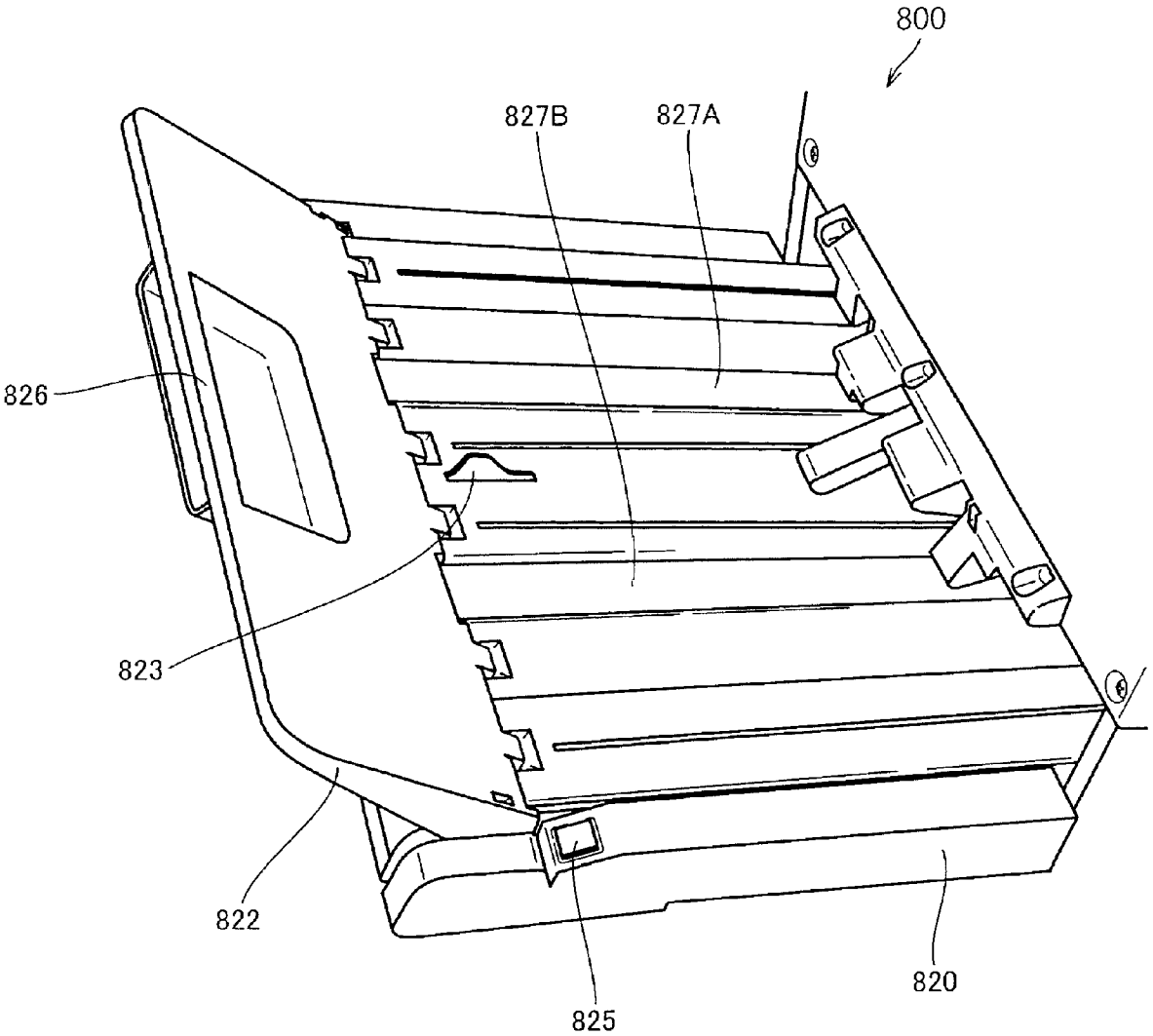
FIG. 5 is a perspective view of a sheet tray 800 according to the embodiment of the present invention.

FIG. 5 is a perspective view of sheet tray 800 according to the embodiment of the present invention.

Referring to FIG. 5, sheet tray 800 includes a loading member 820 and a stopper member 822.

Stopper member 822 has an end portion coupled to loading member 820 and is foldable to lie on loading member 820. Stopper member 822 as well as loading member 820 can be accommodated on the side surface of post-processing apparatus FS.

Stopper member 822 has a grip portion 826. The angle of sheet tray 800 can be adjusted by holding grip portion 826 as described later.

Two conveyance belts 827A, 827B are provided in loading member 820. The folded sheet loaded on sheet tray 800 is conveyed through conveyance belts 827A, 827B.

Movable members 823, 824 are provided in loading member 820. Here, movable member 824 is not shown. When the folded sheet loaded on sheet tray 800 is conveyed through the conveyance belts, the folded sheet comes into contact with movable members 823, 824 to move movable members 823, 824 downward.

A conveyance button 825 is provided in loading member 820. Pressing conveyance button 825 can drive conveyance belts 827A, 827B.

Figure 6:
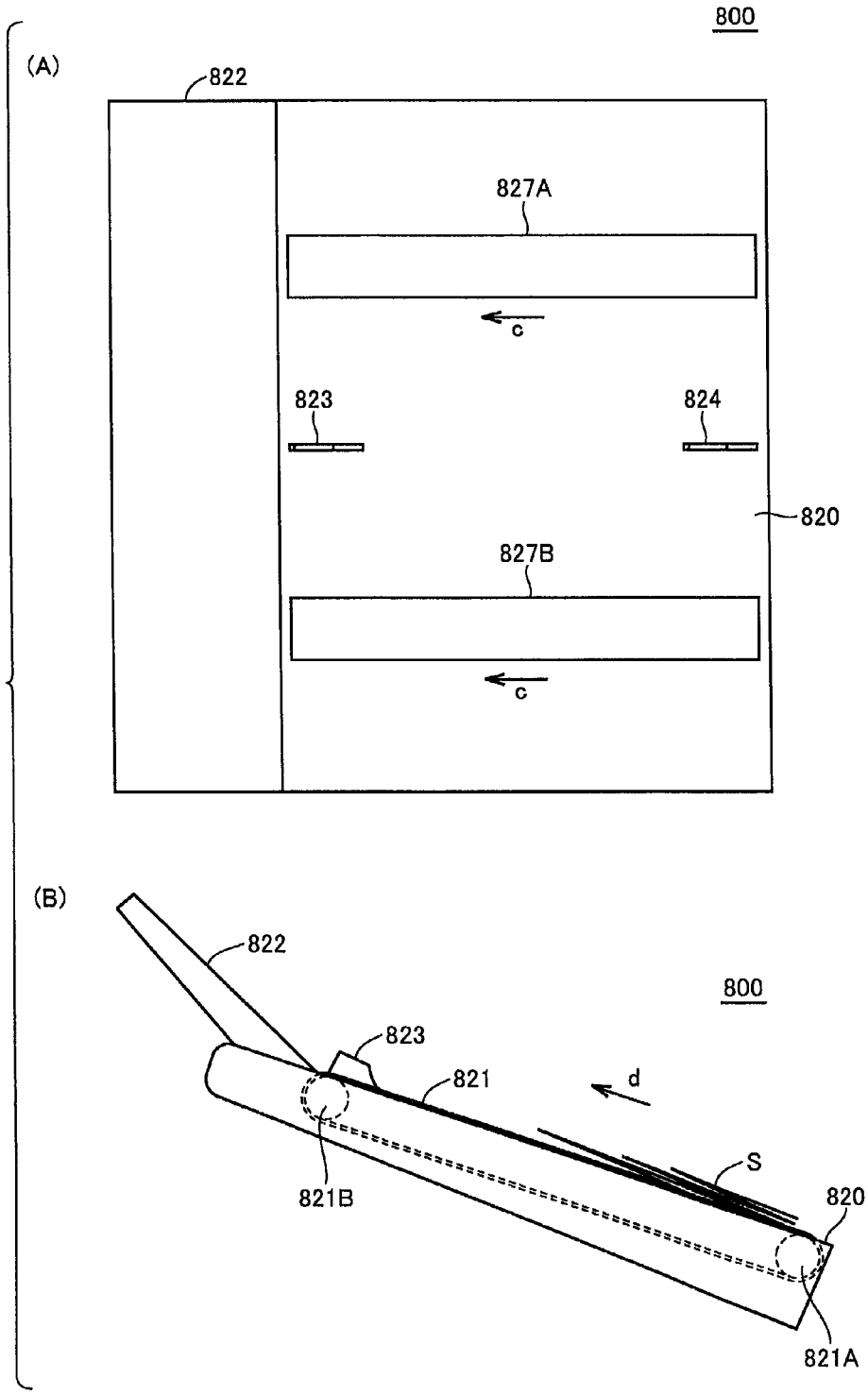
FIG. 6 is a schematic diagram of sheet tray 800 according to the embodiment of the present invention.

FIG. 6 is a schematic diagram of sheet tray 800 according to the embodiment of the present invention.

FIG. 6(A) shows sheet tray 800 as viewed from the top. FIG. 6(B) shows the cross section of sheet tray 800.

Two conveyance belts 827A, 827B, which are conveyance units for conveying the folded sheet, are installed in loading member 820 of sheet tray 800. The rotation of belt conveyance rollers 821A, 821B allows conveyance belts 827A, 827B to rotate in the arrow c direction shown in FIG. 6(A) and in the arrow d direction shown in FIG. 6(B).

As shown in FIG. 6(A), movable member 823 moved by the folded sheet is installed in proximity to the stopper member 822, in the vicinity of the approximately middle point between two conveyance belts 827A and 827B.

Movable member 824 moved by the folded sheet is installed in the vicinity of the entrance on the side opposite to stopper member 822, in the vicinity of the approximately middle point between two conveyance belts 827A and 827B.

The folded sheets ejected to loading member 820 of sheet tray 800 are gradually conveyed in a piled state as shown in the drawing (the piled state of the folded sheets is schematically shown in FIG. 6(B)) by conveyance belts 827A, 827B.

As shown in the drawing, movable member 823 is moved to a hidden position inside loading member 820 when in contact with the leading folded sheet. Inside loading member 820, a sensing member (sheet tray front end sensor) is arranged to sense that movable member 823 is moved to the position inside loading member 820. With the movement of movable member 823, the sensing member can grasp that the folded sheet reaches that position.

Movable member 824 is provided at a position where the folded sheet is ejected to cover movable member 824 when the folded sheet is ejected from folding unit 50 to sheet tray 800. Therefore, when the folded sheet is ejected, movable member 824 is moved to a hidden position inside loading member 820 in a similar manner as movable member 823. Inside loading member 820, a sensing member (sheet tray entrance sensor) is arranged to sense that movable member 824 is moved to the position inside loading member 820. With the movement of movable member 824, the sensing member can sense that the folded sheet is ejected to the position, that is, sheet tray 800.

Figure 7:
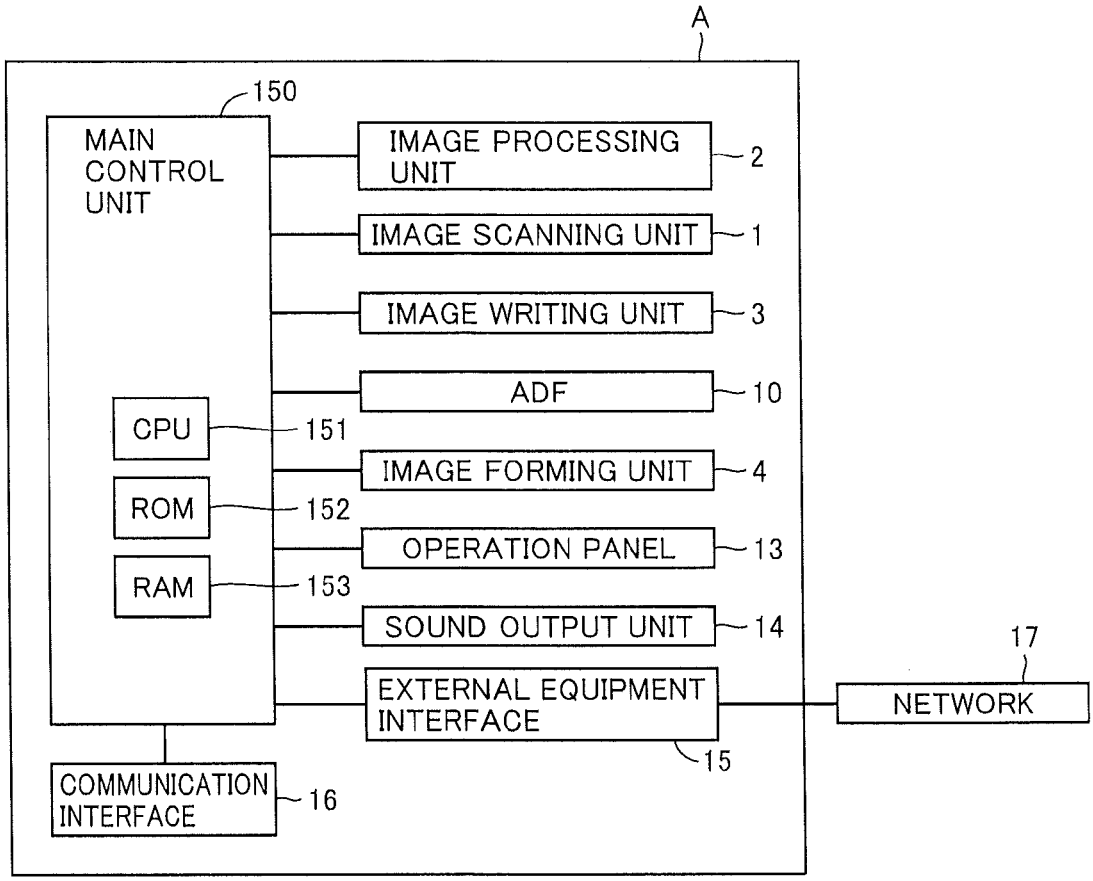
FIG. 7 is a schematic block diagram of image forming apparatus A according to the embodiment of the present invention.

FIG. 7 is a schematic block diagram of image forming apparatus A according to the embodiment of the present invention.

Referring to FIG. 7, image forming apparatus A includes a main control unit 150 controlling the entire apparatus, an image scanning unit 1, an image processing unit 2, an image writing unit 3, an image forming unit 4, an ADF (Automatic Document Feeder) 10, an operation panel 13, a sound output unit 14, an external equipment interface 15, and a communication interface 16.

Main control unit 150 includes a CPU (Central Processing Unit) 151 for executing a variety of programs including an OS (Operating System), a ROM (Read Only Memory) 152 storing the program executed in CPU 151 in advance, and a RAM (Random Access Memory) 153 temporarily storing data necessary to execute the program parts of CPU 151.

Main control unit 150 performs: scanning control of scanning an image from a document loaded on ADF 10 using image scanning unit 1 and converting the image into electronic data; image processing control of performing a variety of image processing on the scanned image using image processing unit 2; image forming control of forming the processed image on a sheet by a known electrophotographic process using image writing unit 3 and image forming unit 4; and sheet feeding control of conveying a sheet having an image formed thereon.

Operation panel 13 has a touch panel and is configured such that the setting of the kind of post-processing for a sheet and the operation settings of other various functions can be made, and the confirmation of the set function and a variety of alarms can be displayed. On operation panel 13, displayed are, for example, a ten-key pad for setting the number of copies, a start key for instructing to start an operation, a stop key to instruct to stop an operation, and a reset key for initializing a variety of setting conditions.

A job including sheet size information and post-processing kind information (for example, whether to fold and staple and the kind thereof, and the number of sheets) is input from operation panel 13 to main control unit 150 based on user's operation.

Main control unit 150 transmits the job to post-processing apparatus FS through communication interface 16.

An error sound such as an operation sound or an alarm sound is output from sound output unit 14 when an error such as paper jam occurs. An external network 17 is connected to external equipment interface 15. This allows communication with other equipment on a network.

Image forming apparatus A includes, in addition to a copy function, a scan function of obtaining image data, a print function of receiving image data from not-shown external equipment such as a personal computer for printing, a fax function of allowing facsimile transmission, and the like.

Figure 8:
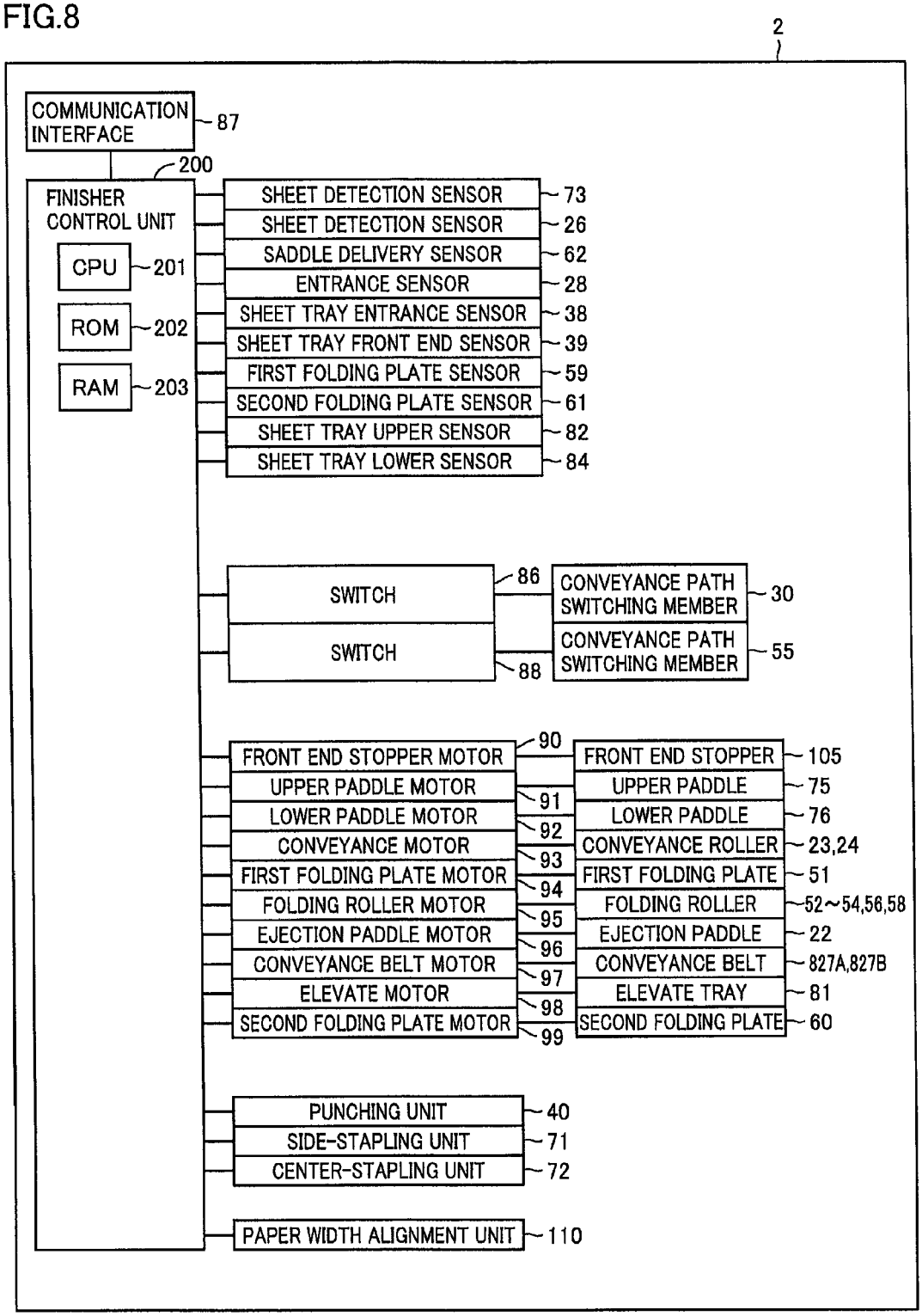
FIG. 8 is a schematic block diagram of post-processing apparatus FS according to the embodiment of the present invention.

FIG. 8 is a schematic block diagram of post-processing apparatus FS according to the embodiment of the present invention.

Referring to FIG. 8, post-processing apparatus FS includes a finisher control unit 200 controlling the entire post-processing apparatus FS, and a communication interface 87 for communicating information with image forming apparatus A.

Finisher control unit 200 includes a CPU 201 for executing a variety of programs including an Operating System, a ROM 202 storing the program executed in CPU 201 in advance, and a RAM 203 temporarily storing data necessary to execute the program parts of CPU 201.

Finisher control unit 200 controls each unit inside post-processing apparatus FS based on the job output from image forming apparatus A.

Finisher control unit 200 is connected to various sensors. Specifically, finisher control unit 200 is connected to sheet detection sensors 26, 73, a saddle delivery sensor 62, an entrance sensor 28, a sheet tray entrance sensor 38, a sheet tray front end sensor 39, a first folding plate sensor 59, a second folding plate sensor 61, a sheet tray upper sensor 82, and a sheet tray lower sensor 84, and receives input of detection signals from the sensors.

Finisher control unit 200 controls switches 86, 88. Switches 86 and 88 are connected to conveyance path switching members 30 and 55, respectively. Switches 86, 88 are switched to change the positions of conveyance path switching members 30, 55 so that the conveyance paths are switched.

Finisher control unit 200 controls various motors.

Front end stopper 105, upper paddle 75, lower paddle 76, conveyance rollers 23, 24, first folding plate 51, folding rollers 52-54, 56, 58, ejection paddle 22, conveyance belts 827A, 827B, elevate tray 81, and second folding plate 60 are driven by a front end stopper motor 90, an upper paddle motor 91, a lower paddle motor 92, a conveyance motor 93, a first folding plate motor 94, a folding roller motor 95, an ejection paddle motor 96, a conveyance belt motor 97, an elevate motor 98, and a second folding plate motor 99, respectively.

Finisher control unit 200 controls punching unit 40, side-stapling unit 71, center-stapling unit 72, paper width alignment unit 110, and the like.

Here for the sake of brevity, a motor for driving each of accommodation belt 70 and accommodation paddle 74 is not shown. This is the same with other components.

Figure 9:
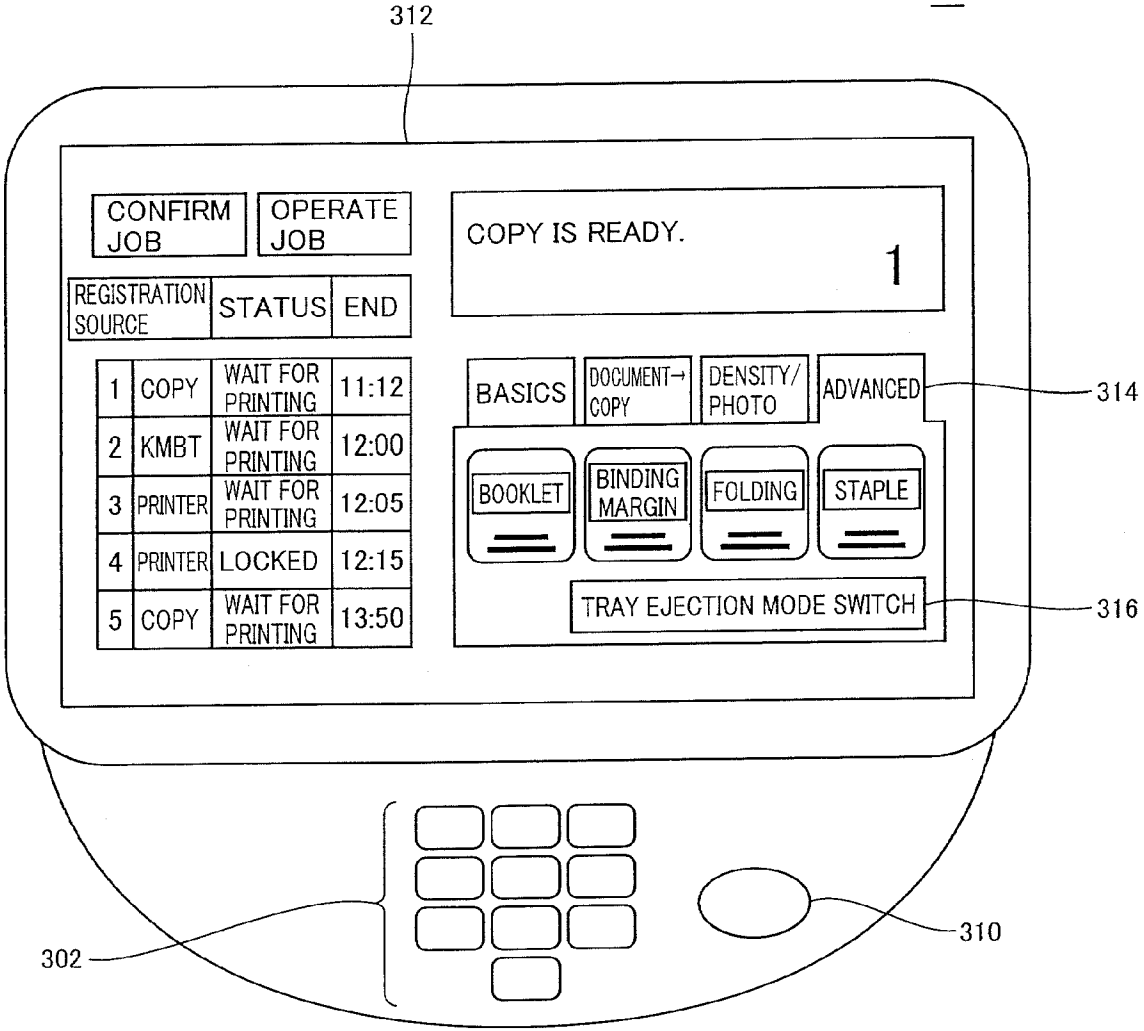
FIG. 9 is an overall view of an operation panel 13 according to the embodiment of the present invention.

FIG. 9 is an overall view of operation panel 13 according to the embodiment of the present invention.

Referring to FIG. 9, operation panel 13 according to the embodiment of the present invention includes a display portion 312, a ten-key pad 302, and a start button 310. Any other key is not shown.

A touch panel is provided on display portion 312, and prescribed operations can be made on display portion 312. Ten-key pad 302 is a button for inputting the number of copies, and the like. Start button 310 is a button to instruct to execute processing such as copy/scan.

A variety of modes and others are displayed on display portion 312. Then, the touch panel allows a variety of settings according to the display content. For example, tab buttons 314 for basic/advanced settings during execution of a copy operation and a scan operation are generally arranged on display portion 312. When each tab button is pressed, a hierarchical screen is displayed for detailed settings. In this example, shown is the case where an advanced tab button is pressed so that detailed settings for a variety of post-processing in post-processing apparatus FS can be specified. Specifically, "booklet mode," "binding margin mode," "folding mode," and "stapling mode" can be specified.

In this example, shown is the case where a tray ejection mode switching button 316 is provided. Pressing tray ejection mode switching button 316 allows switching of tray ejection modes as described later.

Next, a method of adjusting the angle of sheet tray 800 according to the embodiment of the present invention will be described.

Figure 10:
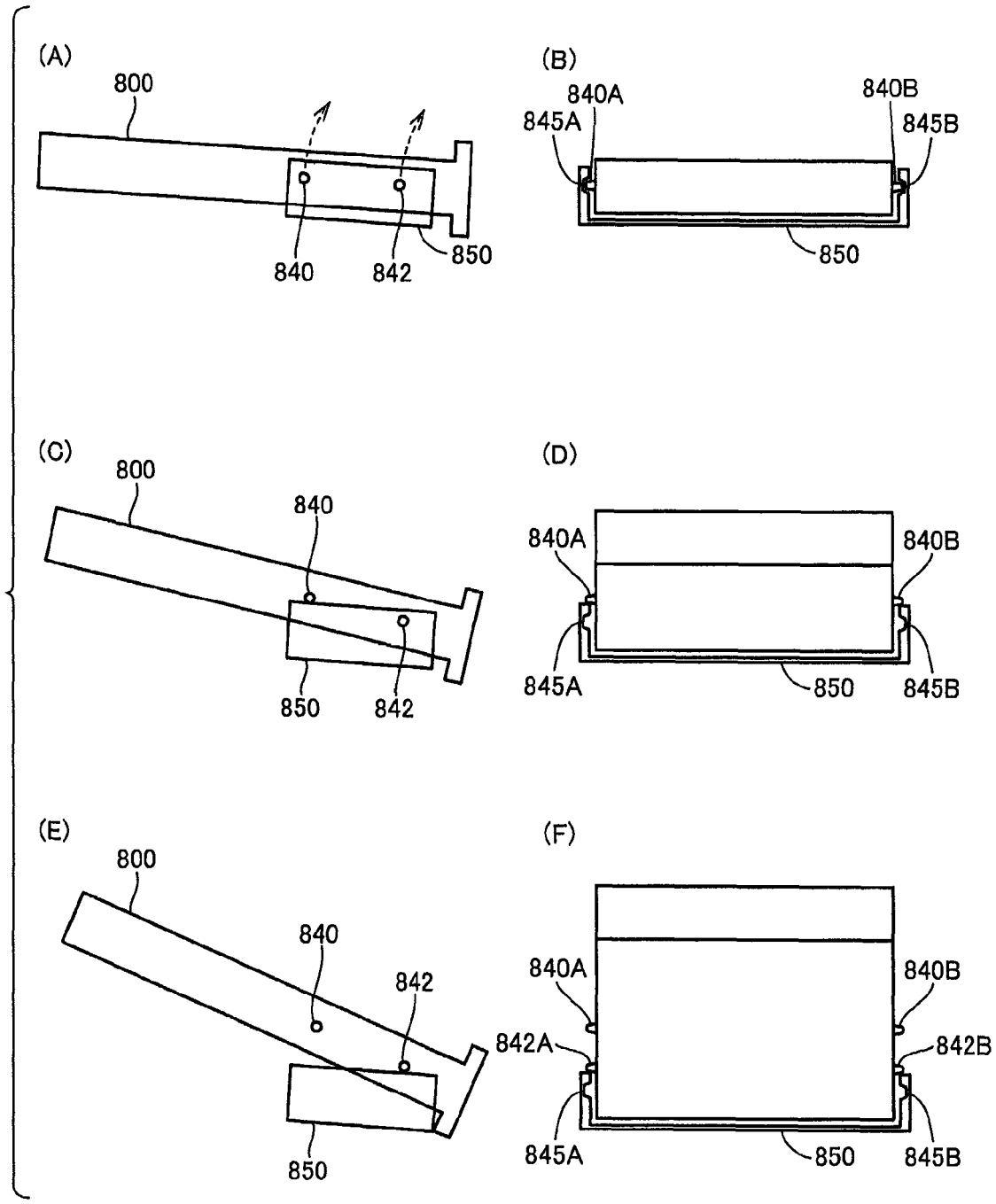
FIG. 10 is a diagram illustrating an adjustment mechanism of sheet tray 800 according to the embodiment of the present invention.

FIG. 10 is a diagram illustrating an adjustment mechanism of sheet tray 800 according to the embodiment of the present invention.

Referring to FIG. 10, the angle of sheet tray 800 according to the embodiment of the present invention can be adjusted in three levels.

Specifically, FIGS. 10(A) (B) illustrate the state in which sheet tray 800 is at the lowest position.

FIGS. 10(C) (D) illustrate the state in which sheet tray 800 is at the intermediate position.

FIGS. 10(E) (F) illustrate the state in which sheet tray 800 is at the highest position.

In this example, the lowest position, the intermediate position, and the highest position are tilted at the angles of 5 degrees, 15 degrees, and 30 degrees, respectively, with respect to the horizontal plane, by way of example.

Referring to FIG. 10(A), sheet tray 800 is accommodated in a tray receiver 850 such that the angle of sheet tray 800 accommodated in tray receiver 850 can be adjusted. Specifically, projection portions 840, 842 are provided on the opposite sides of sheet tray 800. In this example, projection portions 840A, 840B and projection portions 842A, 842B are provided.

Referring to FIG. 10(B), recessed portions are provided in tray receiver 850 corresponding to projection portions 840, 842. Here, recessed portions 845A, 845B are shown corresponding to projection portions 840A, 840B, respectively.

When sheet tray 800 is at the lowest position, projection portions 840A, 840B are fitted in recessed portions 845A, 845B. This is the same with projection portions 842A, 842B.

When sheet tray 800 is lifted using grip portion 826 of stopper member 822 as described above, the left and right walls of tray receiver 850 are pressed and widened by the projection portions of sheet tray 800, so that the projection portions are disengaged from the recessed portions to allow sheet tray 800 to be lifted.

Referring to FIG. 10(C), here, projection portions 840 are disengaged from recessed portions 845A, 845B, and sheet tray 800 is lifted.

Referring to FIG. 10(D), projection portions 840A, 840B of sheet tray 800 rest on the upper end portion of tray receiver 850. This state is the state in which sheet tray 800 is at the intermediate position.

Then, when sheet tray 800 is further lifted using grip portion 826 of stopper member 822, the left and right walls of tray receiver 850 are pressed and widened by the projection portions of sheet tray 800, so that the projection portions are disengaged from the recessed portions to allow sheet tray 800 to be further lifted.

Referring to FIG. 10(E), here, projection portions 842 are disengaged from the recessed portions, and sheet tray 800 is lifted.

Referring to FIG. 10(F), projection portions 842A, 842B of sheet tray 800 rest on the upper end portion of tray receiver 850. This state is the state in which sheet tray 800 is at the highest position.

Here, the angle is adjusted by lifting sheet tray 800 from the lowest position to the highest position. Conversely, the angle can be adjusted by pulling down sheet tray 800 from the highest position to the lowest position.

In this example, the adjustment mechanism including the projection portions and the recessed portions is provided to adjust the angle of sheet tray 800. However, the present invention is not limited thereto, and a motor may be driven according to an instruction, and the angle of sheet tray 800 may be adjusted by driving the motor.

Sheet tray 800 is provided at a low position. Therefore, to take out the folded sheet loaded in sheet tray 800, the users may have to change their position to squat or bend down and may find it difficult to take out the folded sheet. The conveyance button provided in sheet tray 800 is also at a low position and is difficult to operate.

Then, the configuration as described above facilitates removal of the folded sheet from sheet tray 800 by adjusting the angle of sheet tray 800.

Next, a method of detecting the angle of sheet tray 800 according to the embodiment of the present invention will be described.

Figure 11:
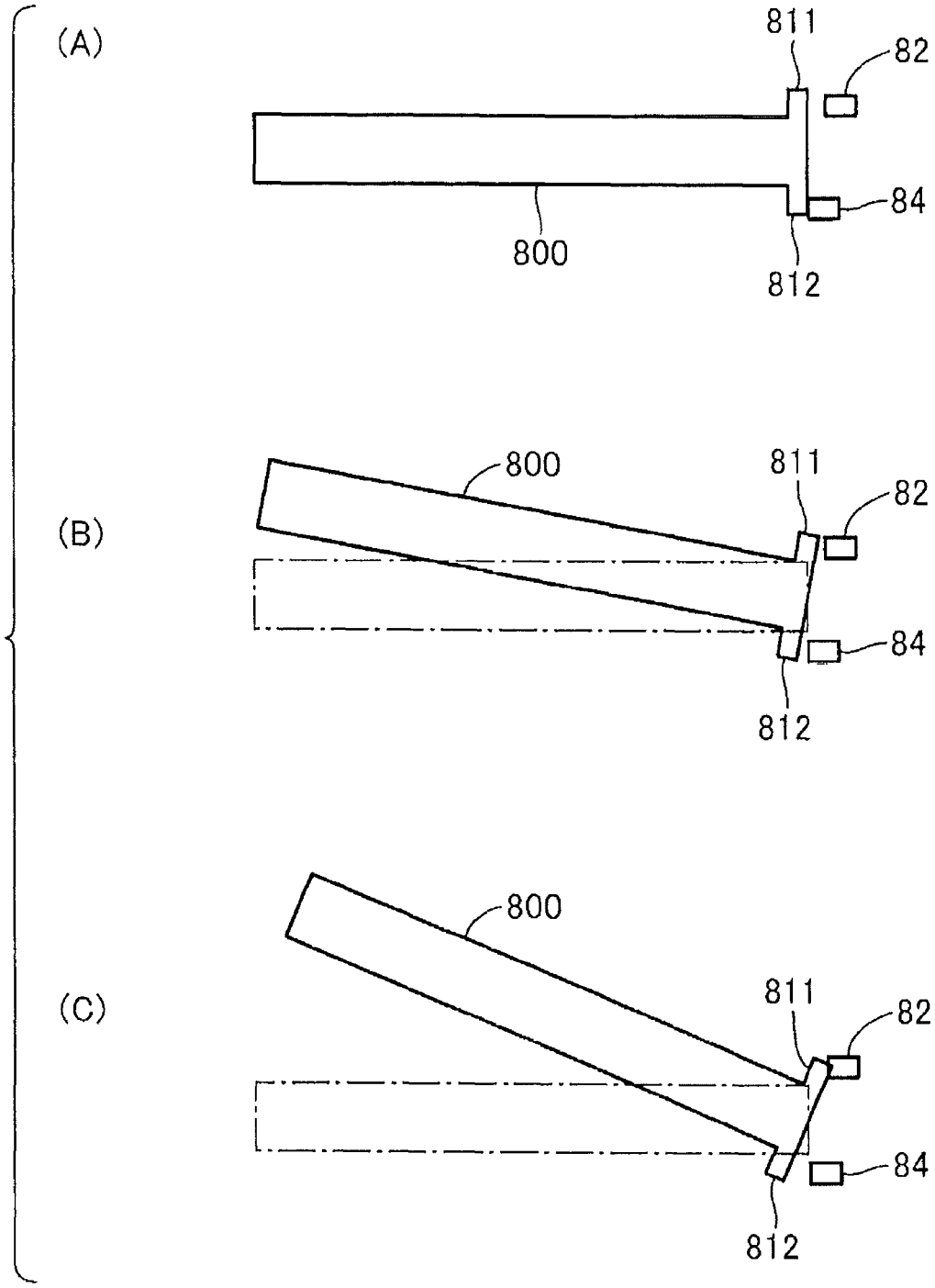
FIG. 11 is a diagram illustrating a method of detecting the angle of sheet tray 800 according to the embodiment of the present invention.

FIG. 11 is a diagram illustrating a method of detecting the angle of sheet tray 800 according to the embodiment of the present invention.

Referring to FIG. 11(A), here shown is the state in which sheet tray 800 is at the lowest position. Sheet tray 800 has an upper edge portion 811 and a lower edge portion 812 extending upward and downward at the end portions. Sheet tray upper sensor 82 and sheet tray lower sensor 84 are provided corresponding to upper edge portion 811 and lower edge portion 812, respectively.

In this example, in the state in which sheet tray 800 is at the lowest position, sheet tray lower sensor 84 reacts to detect lower edge portion 812. On the other hand, sheet tray upper sensor 82 does not detect upper edge portion 811. For example, here, sheet tray lower sensor 84 and sheet tray upper sensor 82 are contact-type sensors, by way of example. Then, in the state in FIG. 11(A), sheet tray lower sensor 84 is in contact with lower edge portion 812.

Referring to FIG. 11(B), here shown is the state in which sheet tray 800 is at the intermediate position.

In this example, neither sheet tray lower sensor 84 nor sheet tray upper sensor 82 is in contact with lower edge portion 812 and upper edge portion 811, respectively, and therefore neither sensor detects any.

Referring to FIG. 11(C), in this example, shown is the state in which sheet tray 800 is at the highest position.

In this example, sheet tray lower sensor 84 is not in contact with lower edge portion 812, whereas sheet tray upper sensor 82 is in contact with upper edge portion 811 and detects upper edge portion 811.

Therefore, the angle of sheet tray 800 can be detected according to three states where only sheet tray lower sensor 84 detects, where neither sheet tray sensor 82 nor 84 detects, and where only sheet tray upper sensor 82 detects.

Next, the folded sheet conveyance modes of sheet tray 800 will be described.

Sheet tray 800 according to the embodiment of the present invention can switch the conveyance modes of the folded sheet loaded on sheet tray 800.

Specifically, the conveyance modes include a sheet alignment conveyance mode and a sheet ejection conveyance mode.

The sheet alignment conveyance mode is a mode in which the folded sheets ejected to sheet tray 800 are stacked and aligned to be conveyed.

The sheet ejection conveyance mode is a mode in which the folded sheets ejected to sheet tray 800 are conveyed to the front end portion of sheet tray 800 such that they can be easily taken out.

In a normal state, that is, when sheet tray 800 is at the lowest position, conveyance control in the sheet alignment conveyance mode is executed, by way of example.

Specifically, CPU 201 of finisher control unit 200 detects the angle of sheet tray 800 based on the detection state of sheet tray upper sensor 82 and sheet tray lower sensor 84. Then, the conveyance control of sheet tray 800 is executed according to the angle. For example, CPU 201 instructs conveyance belt motor 97 to execute the conveyance control according to the sheet alignment conveyance mode. Alternatively, CPU 201 instructs conveyance belt motor 97 to execute the conveyance control according to the sheet ejection conveyance mode.

Figure 12:
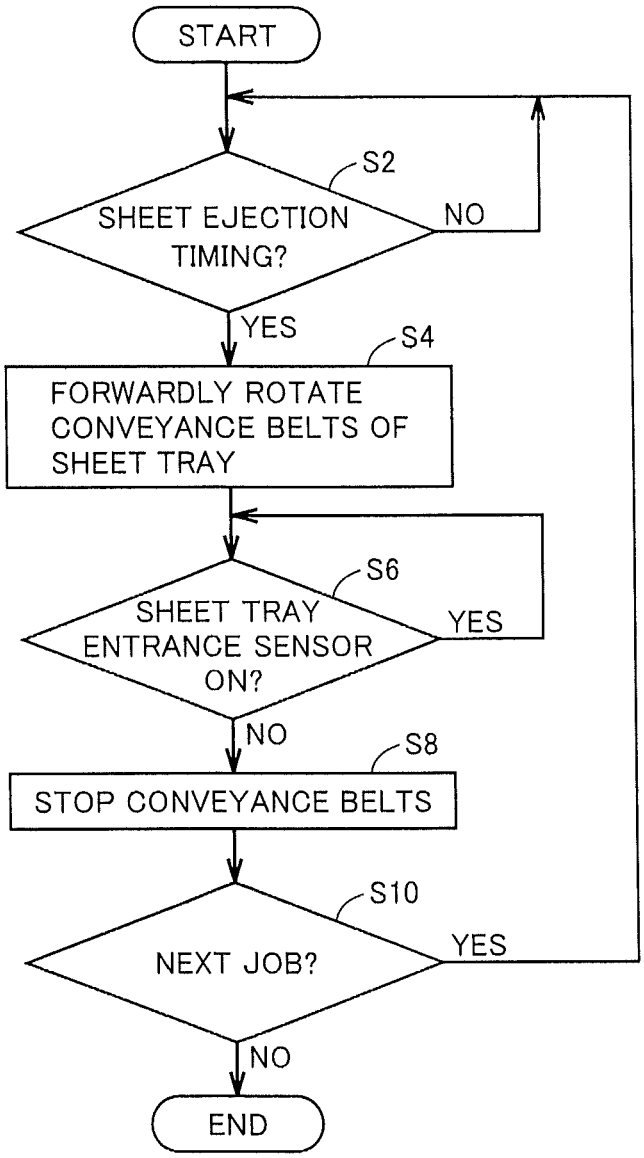
FIG. 12 is a flowchart of a sheet alignment conveyance mode according to the embodiment of the present invention.

FIG. 12 is a flowchart of the sheet alignment conveyance mode according to the embodiment of the present invention. This process is executed by CPU 201 controlling conveyance belt motor 97.

Referring to FIG. 12, in the sheet alignment conveyance mode, first, it is determined whether it is a sheet ejection timing or not (step S2). CPU 201 determines whether the folded sheet processed in folding unit 50 is in an ejection timing.

In step S2, if it is determined that it is the sheet ejection timing (YES in step S2), the conveyance belt is rotated forwardly (step S4). Specifically, immediately before the folded sheet comes into contact with sheet tray 800, conveyance belt motor 97 is instructed to rotate conveyance belts 827A, 827B forwardly (ejection direction).

Then, it is determined whether sheet tray entrance sensor 38 is ON (step S6). CPU 201 determines whether sheet tray entrance sensor 38 provided at the position where the folded sheet is ejected to sheet tray 800 is ON.

In step S6, if it is determined that sheet tray entrance sensor 38 is ON (YES in step S6), that state is kept, and it is determined whether sheet tray entrance sensor 38 turns OFF with the conveyance belts being rotated forwardly.

In step S6, the conveyance belts are rotated forwardly until sheet tray entrance sensor 38 turns OFF, and when sheet tray entrance sensor 38 turns OFF (NO in step S6), the conveyance belts are stopped (step S8).

Then, it is determined whether there exists a next job (step S10). If a next job exists, the process returns to step S2, and the above-noted process is repeated. On the other hand, if a next job does not exist, the process ends (END).

That is, in the sheet alignment conveyance mode, when the ejected folded sheet reaches sheet tray 800 in the sheet ejection timing, movable member 824 is moved to turn sheet tray entrance sensor 38 ON. Then, the ejected folded sheet is conveyed by the conveyance belts until sheet tray entrance sensor 38 turns OFF, and when the back end portion of the ejected folded sheet passes through movable member 824, movable member 824 returns to the initial position. In other words, sheet tray entrance sensor 38 turns OFF, and the conveyance belts stop at the initial position. Then, in the next job, at the sheet ejection timing, the ejected folded sheet causes movable member 824 to turn sheet tray entrance sensor 38 ON again. For example, when movable member 824 is provided at the central portion of the ejected folded sheet, the previously ejected folded sheet and the next ejected folded sheet are overlapped by about half in length. As a result of repeating this process, the folded sheets ejected at regular intervals are stacked and aligned to be conveyed. In other words, this conveyance mode is a mode in which every time the folded sheet is ejected, the conveyance belts are moved (moved stepwise) by a prescribed distance to convey the ejected folded sheet.

CPU 201 of finisher control unit 200 detects the angle of sheet tray 800 based on the detection state of sheet tray upper sensor 82 and sheet tray lower sensor 84. Then, the conveyance control of sheet tray 800 is executed according to the detected angle, and if the angle is not in the normal state, for example, if it is detected that the sheet tray is at the intermediate position or at the highest position, conveyance belt motor 97 is instructed to execute the conveyance control according to the sheet ejection conveyance mode.

Figure 13:
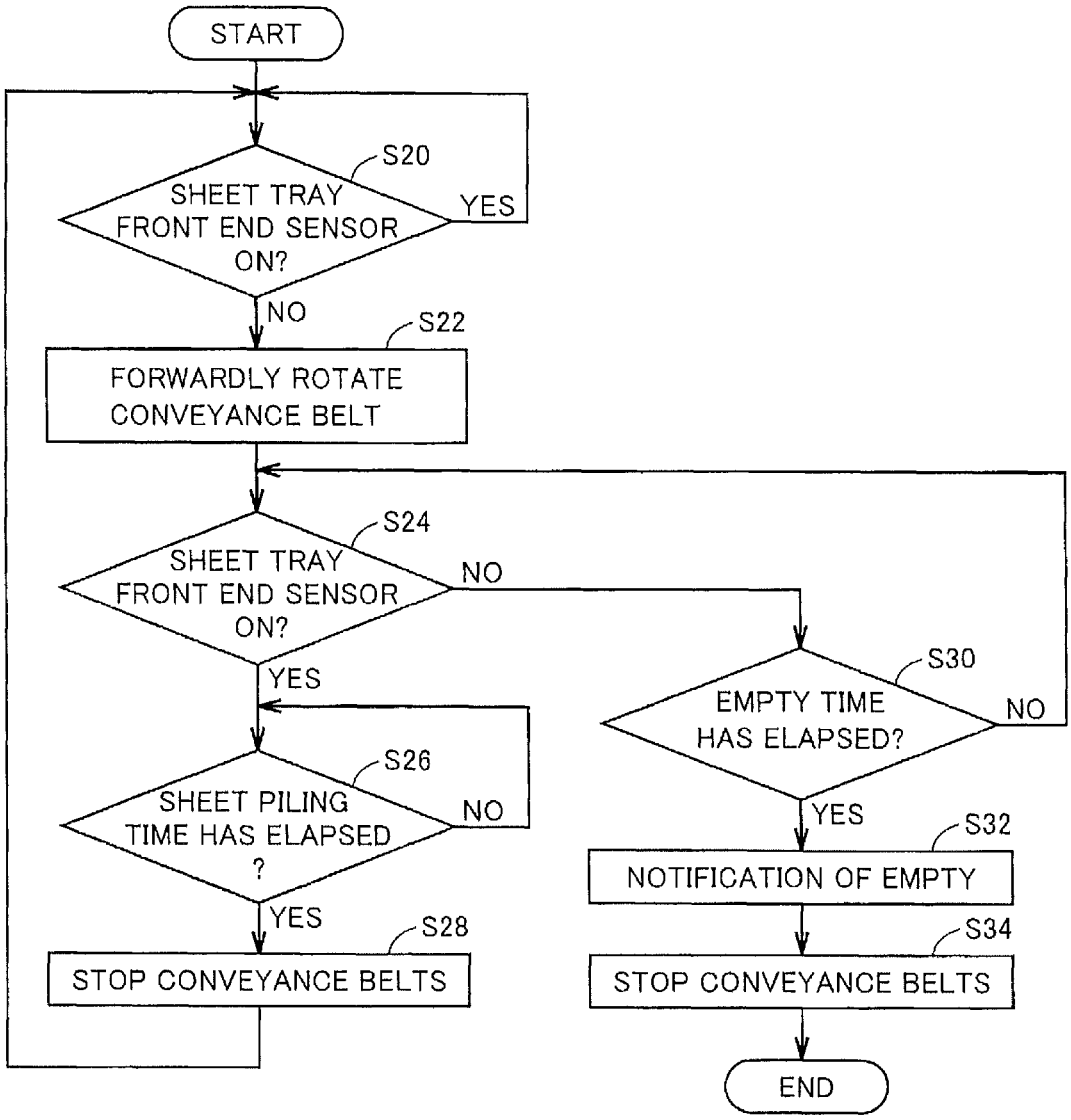
FIG. 13 is a flowchart of a sheet ejection conveyance mode according to the embodiment of the present invention.

FIG. 13 is a flowchart of the sheet ejection conveyance mode according to the embodiment of the present invention. This process is executed by CPU 201 controlling conveyance belt motor 97.

Referring to FIG. 13, it is determined whether sheet tray front end sensor 39 is ON (step S20).

Then, if it is determined that sheet tray front end sensor 39 is ON (YES in step S20), this state is kept.

On the other hand, if it is determined that sheet tray front end sensor 39 is OFF (NO in step S20), the conveyance belts are rotated forwardly (step S22). Specifically, conveyance belt motor 97 is instructed to rotate conveyance belts 827A, 827B forwardly (ejection direction).

Then, it is determined whether sheet tray front end sensor 39 is ON (step S24).

In step S24, if it is determined that sheet tray front end sensor 39 is ON (YES in step S24), it is determined that the sheet piling time has elapsed (step S26).

In step S26, if it is determined that the sheet piling time has elapsed (YES in step S26), the conveyance belts are stopped (step S28). Specifically, conveyance belt motor 97 is instructed to stop conveyance belts 827A, 827B. Then, the process returns to step S20.

On the other hand, if it is determined that the sheet piling time has not elapsed (NO in step S26), the state in step S26 is kept.

In step S24, if it is determined that sheet front end sensor 39 is not ON (NO in step S24), it is determined whether an empty time has elapsed (step S30).

In step S30, if it is determined that the empty time has elapsed (YES in step S30), a notice to indicate empty is given (step S32). Then, the conveyance belts are stopped (step S34). Then, the process ends (END).

On the other hand, in step S30, if it is determined that the empty time has not elapsed (NO in step S30), the process returns to step S24, and it is determined whether sheet tray front end sensor 39 turns ON with the conveyance belts being rotated forwardly. The subsequent process is the same.

That is, in the sheet ejection conveyance mode, if sheet tray front end sensor 39 is not ON based on the detection result of sheet tray front end sensor 39, the folded sheet ejected to sheet tray 800 is conveyed to the end portion by the conveyance belts until sheet tray front end sensor 39 turns ON and the sheet piling time has elapsed.

Therefore, the folded sheet ejected to sheet tray 800 is conveyed to the end portion (front end direction) of sheet tray 800, thereby facilitating removal of the folded sheet loaded on sheet tray 800.

Then, when the folded sheet loaded on the end portion of sheet tray 800 is taken out, sheet tray front end sensor 39 turns off again, and the conveyance belts of sheet tray 800 operate to convey the folded sheets stacked in the vicinity of the entrance of sheet tray 800 toward the end portion, thereby facilitating removal of the folded sheets stacked in the vicinity of the entrance of sheet tray 800.

On the other hand, when sheet tray front end sensor 39 does not turn ON after the elapse of the empty time, it is understood that the folded sheet is not loaded on sheet tray 800. Therefore, in such a case, a notice to indicate empty is given, and the conveyance belts are stopped. This process prevents the unnecessary processing from being kept on.

Here, the stop of the conveyance belts after the elapse of the sheet piling time will be described.

Figure 14:
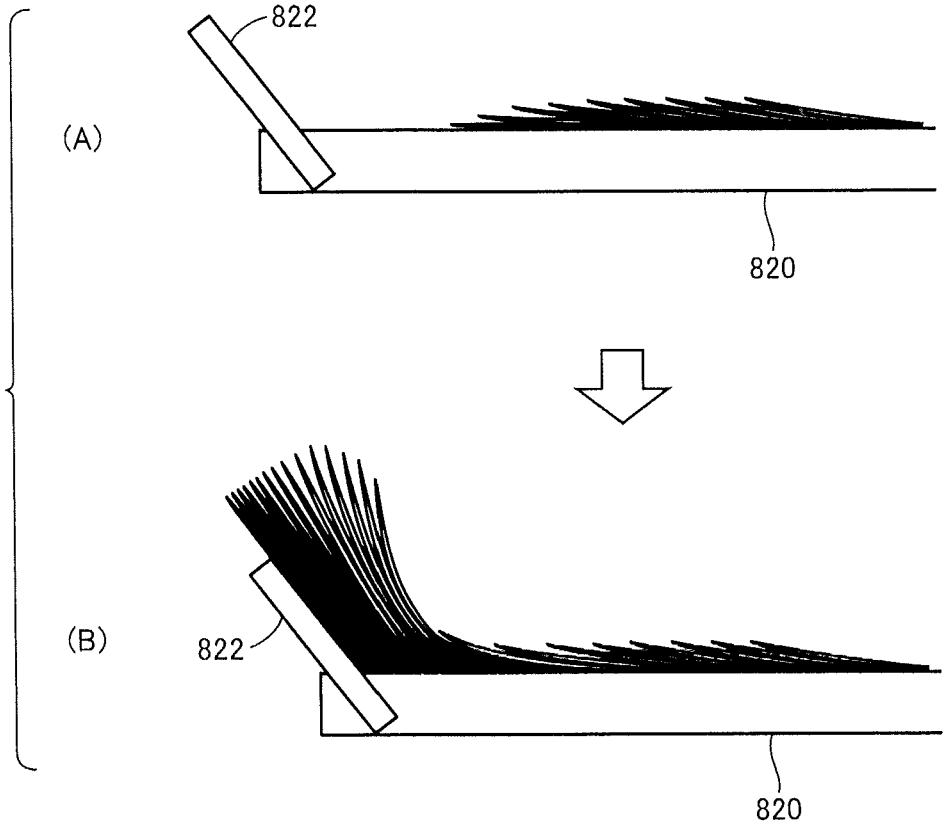
FIG. 14 is a diagram illustrating a state in which folded sheets are piled according to the embodiment of the present invention.

FIG. 14 is a diagram illustrating a state in which folded sheets are piled according to the embodiment of the present invention.

FIG. 14(A) shows that a plurality of folded sheets are loaded on sheet tray 800.

In this state, the conveyance belts of sheet tray 800 are rotated forwardly to cause the stack of folded sheets to be piled through stopper member 822, as shown in FIG. 14(B).

With this state being kept, the conveyance belts of sheet tray 800 are further rotated forwardly to cause the stack of folded sheets to turn upside down. In this example, the conveyance belts of sheet tray 800 are stopped in a state in which the sheets are piled appropriately at stopper member 822.

The sheet piling time is equivalent to a period from when sheet tray front end sensor 39 turns ON to when the folded sheets are piled appropriately at stopper member 822.

This sheet piling time is adjusted according to the angle of sheet tray 800. It is also adjusted by the kind of post-processing mode.

FIG. 15 is a correspondence table of sheet tray 800 and sheet piling time based on post-processing modes.

Referring to FIG. 15, as the angle of sheet tray 800 is smaller, the folded sheets are hardly turned upside down. Conversely, as the angle is larger, the folded sheets are easily turned upside down. In the post-processing mode, the folded sheets have a large height and thus are hardly turned upside down in the three-folding processing, whereas the folded sheets have a large height and thus are easily turned upside down in center-folding. In center-stapling, although the height of folded sheets is the same as center-folding, the front end of folded sheets is stapled and thus heavy, and therefore the sheets are easily turned upside down.

In this example, based on the foregoing, when sheet tray 800 is at the lowest position, the sheet piling time is set to 75 s, 30 s, 22.5 s in three-folding, center-folding, and center-stapling, respectively.

When sheet tray 800 is at the intermediate position, the sheet piling time is set to 45 s, 22.5 s, 15 s in three-folding, center-folding, and center-stapling, respectively.

When sheet tray 800 is at the highest position, the sheet piling time is set to 30 s, 15 s, 7.5 s in three-folding, center-folding, and center-stapling, respectively.

The piling time is based on experiment results obtained with paper size A3, paper weight of 80 g/m$^2$, two staples in center-stapling, and the conveyance belts driven at 20 mm/s.

It is noted that this example is only shown by way of example, and the table may be provided for each paper size, or the sheet piling time may be calculated by multiplying the coefficient according to the paper size.

Based on the sheet piling time, the sheets are piled appropriately at stopper member 822, so that the folded sheets can be easily taken out from sheet tray 800.

Sheet tray 800 is provided at a low position. Therefore, to take out the folded sheet loaded on sheet tray 800, the users may have to change their position to squat or bend down and may find it difficult to take out the folded sheet. The conveyance button provided in sheet tray 800 is also at a low position and may be difficult to operate.

In this example, when the angle of sheet tray 800 is adjusted to change the position of sheet tray 800 from the lowest position, the conveyance mode is switched from the sheet alignment conveyance mode to the sheet ejection conveyance mode, whereby the folded sheets are conveyed to the end portion of sheet tray 800, thereby eliminating the convenience of taking out the folded sheets.

Furthermore, the number of sheets piled at the end portion of sheet tray 800 is adjusted according to the angle, so that the folded sheets can be taken out easily.

The switching of the conveyance modes is not limited to this manner.

For example, the conveyance mode may be switched when a prescribed time has elapsed since job output.

Figure 16:
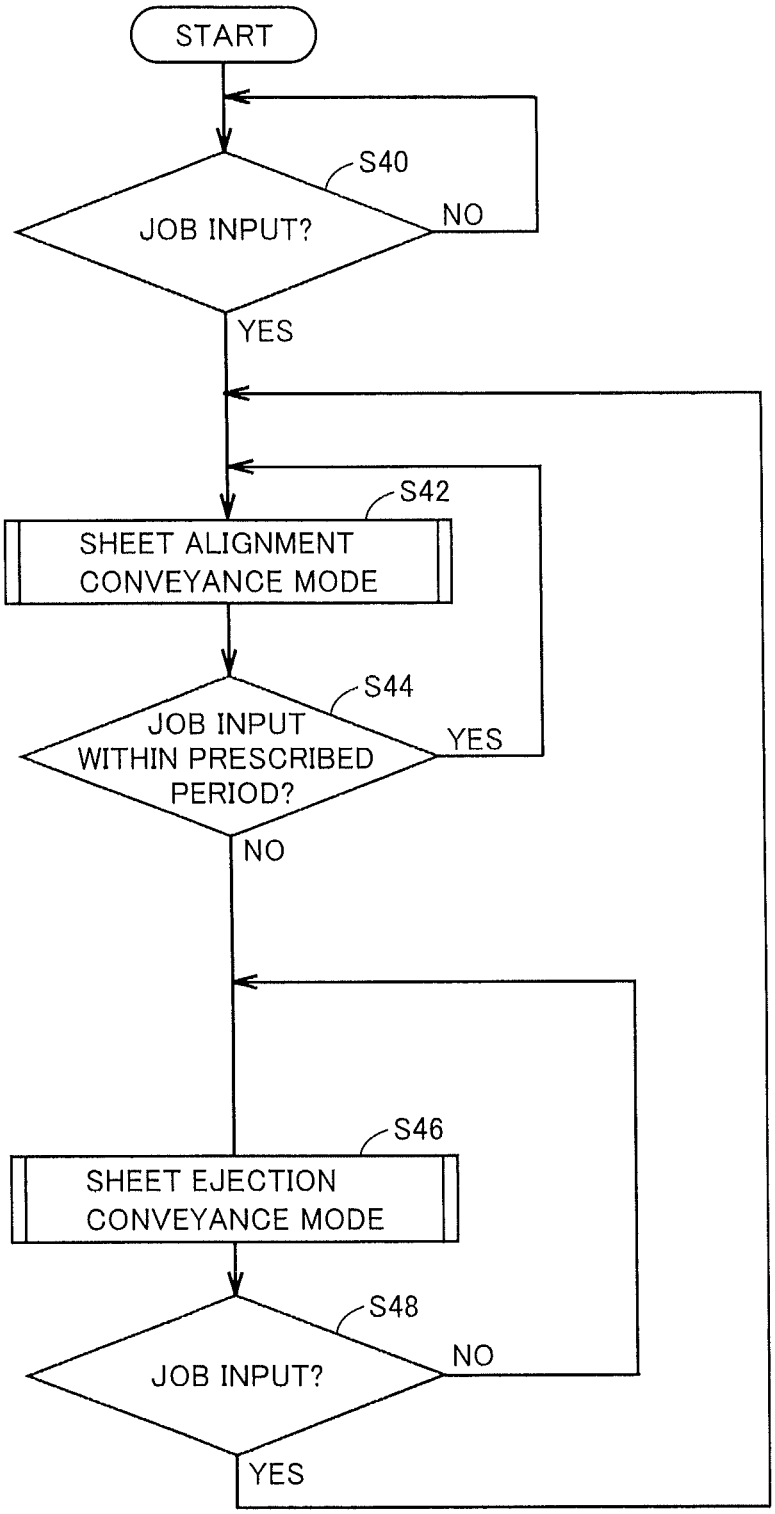
FIG. 16 is a flowchart for executing another conveyance mode switching according to the embodiment of the present invention.

FIG. 16 is a flowchart for executing another conveyance mode switching according to the embodiment of the present invention. This process is executed by CPU 201 controlling conveyance belt motor 97.

Referring to FIG. 16, first, it is determined whether a job is input (step S40). The process waits in step S40 until a job is input.

In step S40, if it is determined that a job is input (YES in step S40), the sheet alignment conveyance mode is executed (step S42). This conveyance mode is illustrated in FIG. 12, and a description thereof will not be repeated.

Then, it is determined whether a job is input within a prescribed period (step S44). If a job is input within a prescribed period (YES in step S44), the process returns to step S42 again, and the sheet alignment conveyance mode is executed.

On the other hand, if no job is input within a prescribed period (NO in step S44), the sheet ejection conveyance mode is executed (step S46). This conveyance mode is illustrated in FIG. 13. It is noted that if a job is input during the flow process in FIG. 13, the process in step S48 is executed by an interrupt.

In step S48, if a job is input (YES in step S48), the process returns to step S42, and the sheet alignment conveyance mode is executed.

In the conveyance mode switching, if a job is input, the conveyance mode in the sheet alignment conveyance mode is executed, whereas if no job is input for a prescribed period, the conveyance mode is switched to the sheet ejection conveyance mode, which conveys the folded sheets to the end portion of sheet tray 800 to facilitate removal of the folded sheets.

The conveyance mode may be switched according to user's instruction from operation panel 13.

Specifically, as described above, tray ejection mode switching button 316 is pressed on operation panel 13 in FIG. 9 to perform switching. For example, when the sheet alignment conveyance mode is set in the initial state, selecting tray ejection mode switching button 316 gives a mode switching instruction to switch from the sheet alignment conveyance mode to the sheet ejection conveyance mode. Specifically, CPU 151 of main control unit 150 of image forming apparatus A accepts input of an operation instruction from operation panel 13 and outputs the accepted input instruction to finisher control unit 200 of post-processing apparatus FS through communication interfaces 16, 87. Then, CPU 201 of finisher control unit 200 switches the conveyance mode of driving conveyance belt motor 97 according to the accepted input instruction.

On the other hand, if the angle of sheet tray 800 is changed as described above, if the folded sheets are elastic depending on the kind of folded sheets and the number of folded sheets, the folded sheets may not be ejected property to sheet tray 800.

In the embodiment of the present invention, a method of restricting the ejection of the folded sheets according to the positional state of sheet tray 800 will be described.

FIG. 17 is a diagram illustrating an ejection restriction table according to the embodiment of the present invention.

Referring to FIG. 17, in the ejection restriction table, the kind and number of sheets that can be processed are defined according to the angle of sheet tray 800.

Specifically, when sheet tray 800 is at the lowest position, up to three sheets of standard paper and up to one sheet of thick paper are permitted in three-folding processing. In the case of center-folding and center-stapling, up to 20 sheets of standard paper and up to five sheets of thick paper are permitted.

When sheet tray 800 is at the intermediate position, up to one sheet of standard paper is permitted and thick paper is prohibited in three-folding processing. In the case of center-folding and center-stapling, up to ten sheets of standard paper are permitted and thick paper is prohibited.

When sheet tray 800 is at the highest position, up to one sheet of standard paper is permitted and thick paper is prohibited in three-folding processing. In the case of center-folding and center-stapling, up to five sheets of standard paper are permitted and thick paper is prohibited.

The ejection restriction table is held beforehand in ROM 202 of post-processing apparatus FS. Then, the information of the ejection restriction table is output to image forming apparatus A through communication interface 87. The image forming apparatus A receives the information of the ejection restriction table through communication interface 16 and stores the received information in RAM 153 of main control unit 150. CPU 151 of post-processing apparatus FS outputs the state (the highest position, the intermediate position, the lowest position) of sheet tray 800 to image forming apparatus A through communication interface 87. The state of sheet tray 800 can be determined based on sheet tray upper sensor 82 and sheet tray lower sensor 84 as described above.

Image forming apparatus A can refer to the ejection restriction table stored in RAM 153 in response to the state information of sheet tray 800 through communication interface 16 and obtain the information about the restriction on two-folding processing and three-folding processing of post-processing apparatus FS.

CPU 151 obtains the information about the restriction on two-folding processing or three-folding processing according to the state of sheet tray 800 based on the ejection restriction table stored in RAM 153 to control the user's input on operation panel 13. More specifically, the user's input of two-folding processing or three-folding processing that exceeds the restricted range is not accepted from operation panel 13. Display portion 312 of operation panel 13 can present the information about the kind and number of sheets that can be designated and input by the user from operation panel 13 for two-folding processing or three-folding processing.

The ejection restriction table can be used to restrict such a job input by the user on operation panel 13 that results in improper ejection to sheet tray 800.

In this example, the contents of restriction differ based on the number of times of folding (two-folding, three-folding). However, the table may be only based on the kind of sheet (standard paper, thick paper) without being dependent on the number of times of folding. Alternatively, conversely, the table may be only based on the number of times of folding without being dependent on the kind of sheet. Alternatively, the table may simply restrict the number of sheets being ejected according to the state of sheet tray 800, without being dependent on the kind of sheet or the number of times of folding.

The contents of the table are shown only by way of example and may be modified as appropriate based on, for example, the angle of sheet tray 800.

On the other hand, the state of sheet tray 800 may be changed by the user during job execution.

Figure 18:
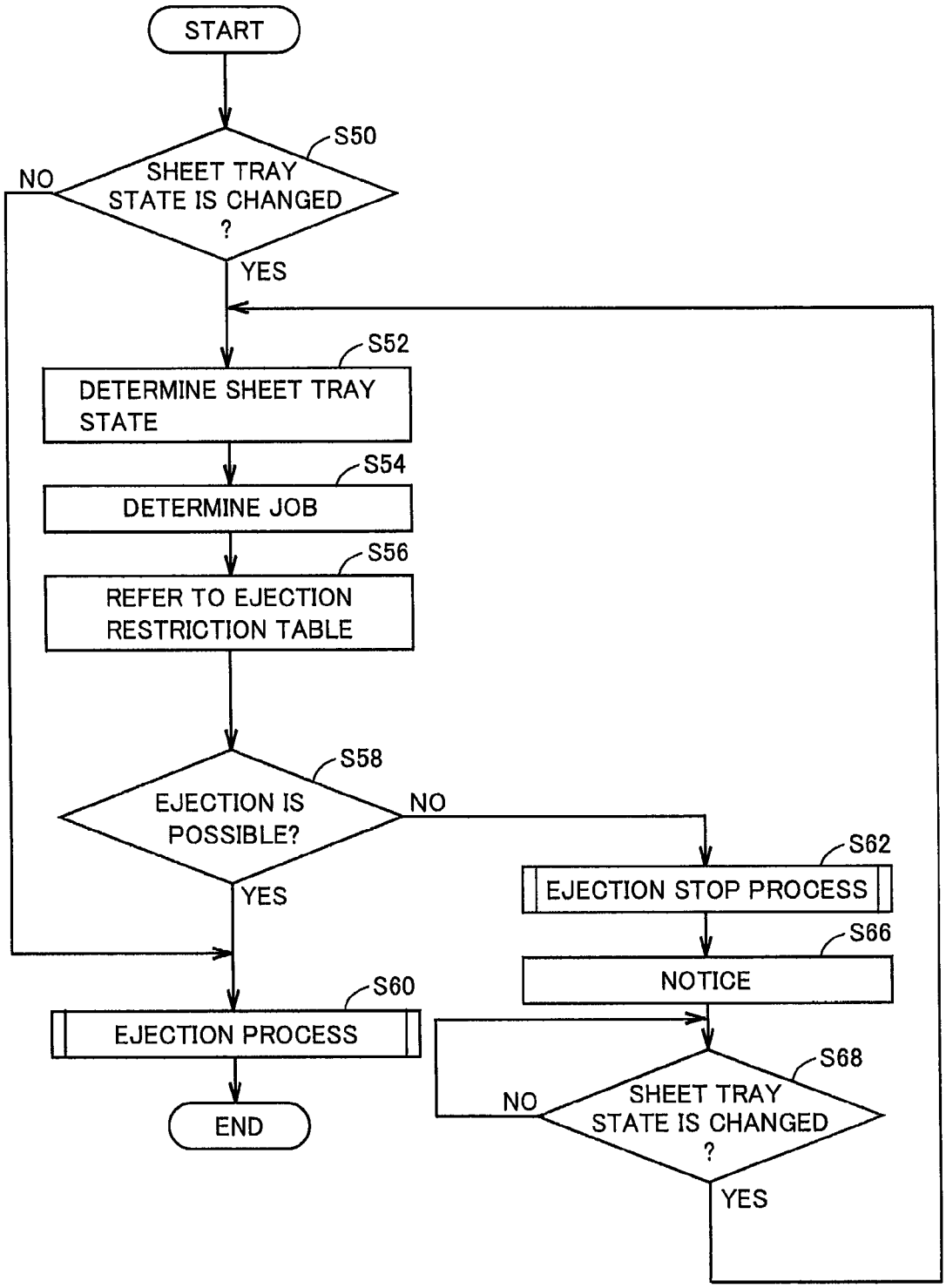
FIG. 18 is a flowchart illustrating an ejection process during job execution for sheet tray 800 of post-processing apparatus FS according to the embodiment of the present invention.

FIG. 18 is a flowchart illustrating an ejection process during job execution for sheet tray 800 of post-processing apparatus FS according to the embodiment of the present invention. This process is executed in CPU 201 of finisher control unit 200.

Referring to FIG. 18, it is determined whether the state of the sheet tray is changed (step S50). Specifically, CPU 201 determines whether the state of sheet tray 800 is changed based on the detection result of sheet tray upper sensor 82 and sheet tray lower sensor 84.

Then, it is determined whether the state of the sheet tray is changed. If it is determined that the state is changed (YES in step S50), the state of the sheet tray is determined (step S52). Specifically, CPU 201 determines which position is assumed by sheet tray 800 based on sheet tray upper sensor 82 and sheet tray lower sensor 84.

Then, the job is determined (step S54). Specifically, CPU 201 determines the kind and number of sheets, etc. included in the job received from image forming apparatus A through communication interface 87.

Then, the ejection restriction table is referred (step S56). Specifically, the ejection restriction table stored in ROM 202 as illustrated in FIG. 17 is referred.

Then, it is determined whether ejection is possible (step S58). CPU 201 determines whether ejection is possible, that is, the ejection conditions are satisfied, according to the ejection restriction table, based on the determined contents of the job and the state of the sheet tray.

In step S58, if it is determined that ejection is possible (YES in step S58), the motor provided in saddle 100 is instructed to execute an ejection process (step S60). The ejection process will be described later.

On the other hand, in step S58, if it is determined that ejection is not possible (NO in step S58), the motor provided in saddle 100 is instructed to execute an ejection stop process (step S62). More specifically, no sheet is ejected to sheet tray 800. The ejection stop process will be described later.

Then, a notification that ejection is stopped is given to image forming apparatus A (step S66). Specifically, CPU 201 notifies image forming apparatus A through communication interface 87 that ejection is stopped. Image forming apparatus A receives the notification through communication interface 16 to give a notice by producing an alarm sound using sound output unit 14 or by indicating that ejection is stopped on operation panel 13. The notification may be such display on operation panel 13 that prompts the user to change the angle of sheet tray 800.

When the user newly operates operation panel 13, control can be performed such that two-folding processing or three-folding processing is not accepted. It is noted that the usual post-processing not using saddle 100, for example, punching processing can be accepted.

Then, it is determined whether the state of the sheet tray is changed (step S68). CPU 210 determines whether the state of sheet tray 800 is changed based on the detection result of sheet tray upper sensor 82 and sheet tray lower sensor 84.

If it is determined that the state of sheet tray 800 is changed (YES in step S68), the process returns to step S52. Then, the process above is repeated. If it is determined that ejection is possible even when the state of sheet tray 800 is changed, the process proceeds to step S60, and the ejection process is executed.

On the other hand, if it is determined that ejection is not possible even when the state of the sheet tray is changed, the ejection stop process is kept on.

In step S68, if it is determined that the state of sheet tray 800 is not changed (NO in step S68), the state in step S68 is kept on.

On the other hand, in step S50, if it is determined that the state of sheet tray 800 is not changed, the process proceeds to step S60, and the ejection process is executed.

Figure 19:
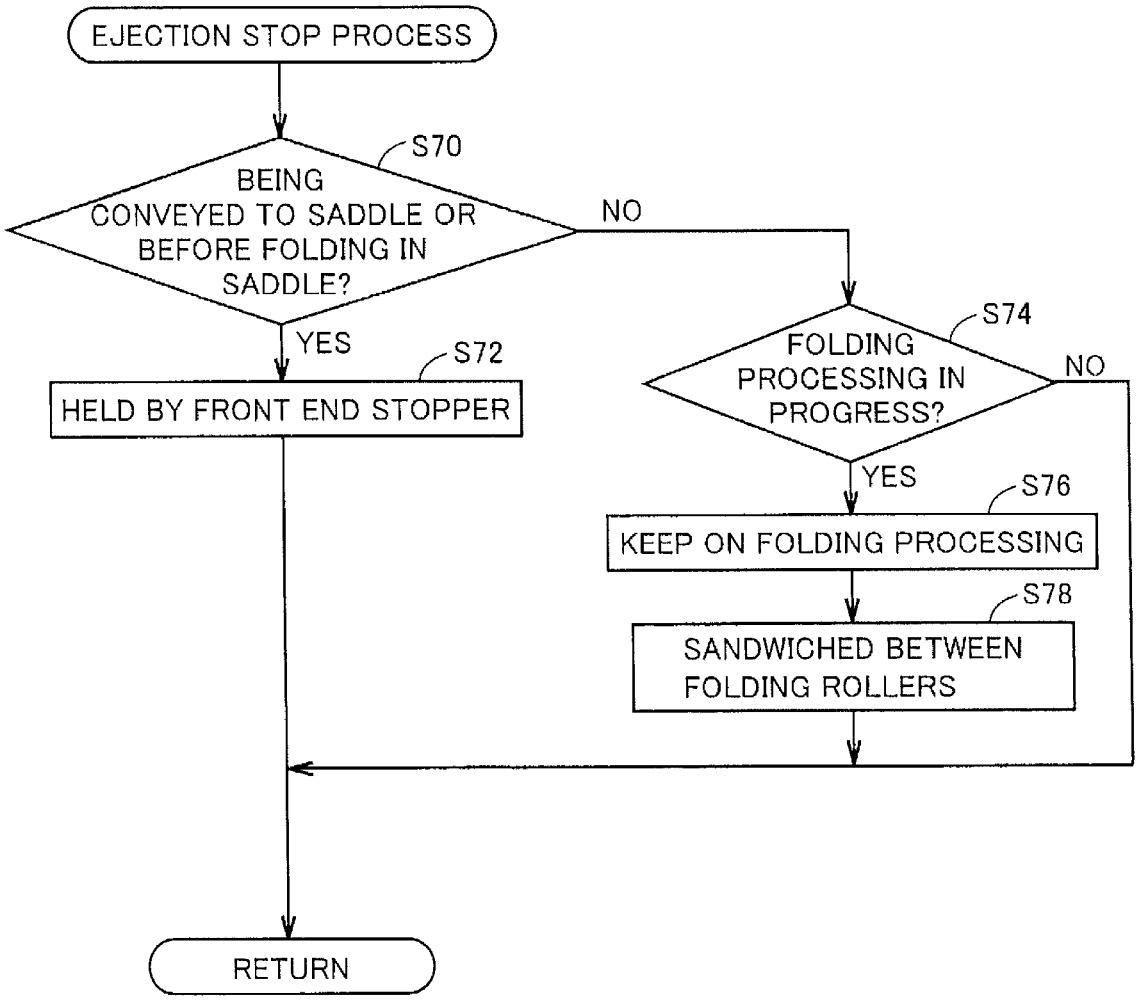
FIG. 19 is a flowchart illustrating an ejection stop process according to the embodiment of the present invention.

FIG. 19 is a flowchart illustrating the ejection stop process according to the embodiment of the present invention.

Referring to FIG. 19, first, it is determined whether the sheet is being conveyed to the saddle or is in the saddle prior to folding processing (step S70). Specifically, CPU 201 determines whether the sheet is being conveyed to the saddle or determines the state of the sheet in the saddle, based on saddle delivery sensor 62, first folding plate sensor 59, second folding plate sensor 61, and the like.

In step S70, if it is determined that the sheet is being conveyed to the saddle or is in the saddle prior to folding processing (YES in step S70), the sheet is held by the front end stopper (step S72). Specifically, CPU 201 instructs the motor provided in saddle 100 so that the sheet is supported by the front end stopper.

Then, the process ends (RETURN).

On the other hand, in step S70, if it is determined that the sheet is not being conveyed to the saddle or is not prior to folding processing in the saddle (NO in step S70), it is determined whether folding processing is in progress (step S74). Specifically, CPU 201 determines whether folding processing is in progress in the saddle, based on first folding plate sensor 59, second folding plate sensor 61, and the like.

In step S74, if it is determined that folding processing is in progress (YES in step S74), the folding processing is kept on (step S76).

Then, the sheet is sandwiched between the folding rollers (step S78). CPU 201 stops the rotation of the folding rollers at a timing when the sheet after folding processing is sandwiched and held between the folding rollers. For example, in the case of two-folding, the sheet is sandwiched between folding rollers 56 and 58. In the case of three-folding, the sheet is sandwiched between folding rollers 53 and 54.

Then, the process ends (RETURN).

In step S74, if it is determined that folding processing is not in progress (NO in step S74), the process ends (RETURN).

In this process, when it is determined that ejection is not possible, and when the determination is prior to folding processing, the sheet before folding processing is stopped in a state in which it is held by the front end stopper with less load on the sheet before folding processing. In this example, the sheet is held by the front end stopper as an example of stopping the sheet with less load on the sheet. However, the present invention is not limited thereto, and the sheet may be stopped in any other state as long as the load on the sheet is small.

When it is determined that ejection is not possible, and when the determination is that folding processing is in progress, the process continues until completion of the folding processing and stops in a state in which sheet ejection is possible. If the sheet is stopped during the course of folding processing, the sheet may be under load, for example, in a warped state. However, the process continues until completion of the folding processing, so that unnecessary load is not applied. In addition, the sheet is stopped at a position immediately before ejection, so that the paper ejection process can be performed immediately after resumption.

Figure 20:
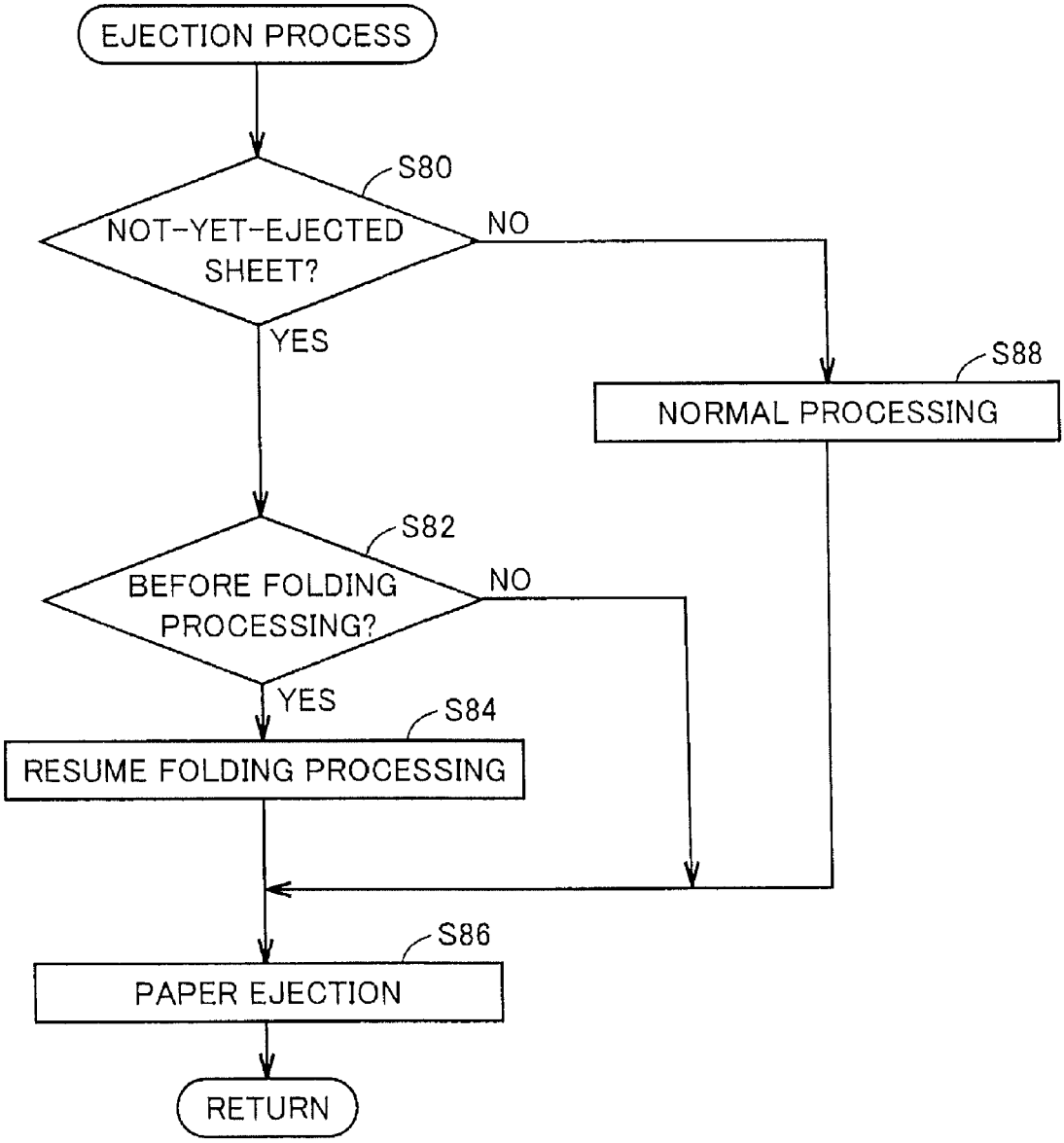
FIG. 20 is a flowchart illustrating an ejection process according to the embodiment of the present invention.

FIG. 20 is a flowchart illustrating the ejection process according to the embodiment of the present invention.

Referring to FIG. 20, it is determined whether a not-yet-ejected sheet exists (step S80). Specifically, CPU 201 can make determination based on whether the ejection stop process is previously executed. Alternatively, for example, a sensor may be used to determine whether a not-yet-ejected sheet exists in saddle 100 or between the folding rollers.

In step S80, if it is determined that a not-yet-ejected sheet exists (YES in step S80), it is determined whether the sheet is prior to folding processing (step S82). Specifically, CPU 201 can make determination based on whether the sheet is stopped by the front end stopper in the previous ejection stop process. Alternatively, for example, a sensor may be used to grasp the state of the not-yet-ejected sheet.

In step S82, if it is determined that the sheet is prior to folding processing (YES in step S82), the folding processing is resumed (step S84). Specifically, CPU 201 instructs folding unit 50 to execute the intended folding processing.

Then, after execution of the folding processing, paper ejection is executed (step S86). The sheet after folding processing is ejected to sheet tray 800.

Then, the process ends (RETURN).

On the other hand, in step S82, if it is determined that the sheet is not prior to folding processing (NO in step S82), that is, if it is determined that the folded sheet is sandwiched between the folding rollers, paper ejection is executed (step S86). Specifically, CPU 201 can make determination based on whether the sheet is stopped in a state in which it is sandwiched between the folding rollers in the previous ejection stop process. Alternatively, for example, a sensor may be used to grasp the state of the not-yet-ejected sheet. If it is determined that the sheet is in such a state, the folding rollers are instructed to eject the folded sheet to sheet tray 800.

Then, the process ends (RETURN).

On the other hand, in step S80, if it is determined that a not-yet-ejected paper does not exist (NO in step S80), the normal processing is executed (step S88). Specifically, the folding processing or the like is executed according to the contents of the job as described above.

Then, paper ejection is executed (step S86). The folding rollers are instructed to eject the folded sheet to sheet tray 800.

Then, the process ends (RETURN).

In this manner, when the state of sheet tray 800 is changed during job execution, it is determined whether ejection is possible according to the ejection restriction table. If it is determined that ejection is not possible, the ejection process is stopped. Therefore, when the folded sheet cannot be ejected properly according to the state of sheet tray 800, ejection is stopped. Then, at the moment when the state of sheet tray 800 is changed and proper ejection to sheet tray 800 becomes possible, the folded sheet is ejected to sheet tray 800. Therefore, it becomes possible to eject the folded sheet properly to sheet tray 800.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A sheet processing apparatus for processing a sheet having an image formed thereon by an image forming apparatus, comprising:

a sheet folding unit for folding the sheet having an image formed thereon;

a sheet tray to be loaded with the sheet folded by the sheet folding unit; and a control unit for controlling the sheet processing apparatus, the sheet tray including a mechanism capable of adjusting an angle with respect to a virtual plane, and a detection device for detecting a change of the angle with respect to the virtual plane, wherein the control unit determines whether ejection from the sheet folding unit to the sheet tray is possible based on: (i) a detection result of the detection device, and (ii) a content of folding processing to be performed in the sheet folding unit, and wherein the control unit prohibits ejection from the sheet folding unit to the sheet tray based on the determination of whether ejection is possible.

2. The sheet processing apparatus according to claim 1, wherein the content of folding processing comprises a number of times of folding processing in the sheet folding unit.

3. The sheet processing apparatus according to claim 1, wherein the content of folding processing comprises a kind of the sheet to be folded by the sheet folding unit.

4. The sheet processing apparatus according to claim 1, wherein the content of folding processing comprises a number of the sheets to be folded by the sheet folding unit.

5. The sheet processing apparatus according to claim 1, wherein the sheet tray includes a conveyance belt for conveying the sheet, and in a first conveyance mode, the control unit ejects the sheet loaded so as to be stacked by moving the conveyance belt stepwise, and in a second conveyance mode, the control unit ejects the sheet loaded so as to be positioned at an end portion of the sheet tray by moving the conveyance belt.

6. The sheet processing apparatus according to claim 5, wherein the sheet tray further includes a first sensor for detecting a position of the sheet folded by the sheet folding unit and ejected onto the sheet tray, and a second sensor for detecting a position of the sheet conveyed to an end portion of the sheet tray by the conveyance belt.

7. The sheet processing apparatus according to claim 6, wherein in the first conveyance mode, the control unit uses the first sensor to sense the sheet folded by the sheet folding unit and ejected onto the sheet tray, moves the conveyance belt in response to sensing by the first sensor, and moves the conveyance belt until the first sensor no longer senses the sheet, and in the second conveyance mode, the control unit uses the second sensor to sense the sheet folded by the sheet folding unit and ejected onto the sheet tray, and moves the conveyance belt until a prescribed period has elapsed.

8. The sheet processing apparatus according to claim 7, wherein the sheet folding unit is capable of performing a plurality of processing on the sheet according to an instruction, and the control unit adjusts the prescribed period depending on the processing performed by the sheet folding unit.

9. The sheet processing apparatus according to claim 5, wherein the control unit switches the first and second conveyance modes from one to another based on a detection result of the detection device.

10. The sheet processing apparatus according to claim 5, wherein the control unit ejects the sheet folded by the sheet folding unit so as to be stacked, according to the first conveyance mode, in response to input of a job to the sheet folding unit until the job is completed, the control unit determines whether a new job is input after completion of the job, and if it is determined that no new job is input, the control unit switches the first conveyance mode to the second conveyance mode and moves the conveyance belt to eject the sheet such that the sheet is positioned at an end portion of the sheet tray, and in the second conveyance mode, when a new job is input, the control unit switches the second conveyance mode to the first conveyance mode.

11. The sheet processing apparatus according to claim 5, wherein the control unit switches the first and second conveyance modes from one to another according to an instruction from an operation panel provided in the image forming apparatus.

* * * * *